US008506728B2

(12) United States Patent
Katsura et al.

(10) Patent No.: US 8,506,728 B2
(45) Date of Patent: Aug. 13, 2013

(54) SURFACE TREATMENT METHOD OF METAL MATERIAL

(75) Inventors: Daiji Katsura, Hiroshima (JP); Tsutomu Shigenaga, Hiroshima (JP)

(73) Assignee: Mazda Motor Corporation (JP)

( * ) Notice: Subject to any disclaimer, the term of this patent is extended or adjusted under 35 U.S.C. 154(b) by 407 days.

(21) Appl. No.: 12/839,034

(22) Filed: Jul. 19, 2010

(65) Prior Publication Data

US 2011/0048584 A1 Mar. 3, 2011

(30) Foreign Application Priority Data

Sep. 3, 2009 (JP) ..... 2009-203999
Oct. 26, 2009 (JP) ..... 2009-245084

(51) Int. Cl.
*C23C 22/05* (2006.01)

(52) U.S. Cl.
USPC ..... 148/247; 148/240; 148/243

(58) Field of Classification Search
USPC ..... 148/247, 240, 243
See application file for complete search history.

(56) References Cited

U.S. PATENT DOCUMENTS

| | | | | |
|---|---|---|---|---|
| 6,214,132 | B1 | 4/2001 | Nakayama et al. | |
| 7,510,612 | B2 | 3/2009 | Matsukawa et al. | |
| 2009/0084682 | A1 * | 4/2009 | McMillen et al. | 205/50 |
| 2009/0223601 | A1 | 9/2009 | Katsura et al. | |

FOREIGN PATENT DOCUMENTS

| | | | |
|---|---|---|---|
| EP | 2 100 986 | A1 | 9/2009 |
| GB | 1 293 884 | A | 10/1972 |
| GB | 2 174 719 | A | 11/1986 |
| JP | S62-284087 | A | 12/1987 |
| JP | H10-121262 | A | 5/1998 |
| JP | H10-140371 | A | 5/1998 |
| JP | H10-245685 | A | 9/1998 |
| JP | H11-061431 | A | 3/1999 |
| JP | H11-502569 | A | 3/1999 |
| JP | 2002-60960 | A | 2/2002 |
| JP | 2007-39765 | A | 2/2007 |
| JP | 2007-204835 | A | 8/2007 |
| JP | 2007-224426 | A | 9/2007 |
| JP | 2009-097093 | A | 5/2009 |
| WO | 2007/117043 | A1 | 10/2007 |
| WO | 2009/045845 | A2 | 4/2009 |
| WO | WO 2009/045845 | A2 * | 4/2009 |
| WO | 2009/145088 | A1 | 12/2009 |

OTHER PUBLICATIONS

English translation of the Japanese Office Action issued on Aug. 21, 2012; Japanese Patent Application No. 2009-203999.
English translation of the Japanese Office Action "Notice of Reasons for Rejection" dated Dec. 6, 2011; Japanese Patent Application No. 2009-245084.
The partial European Search Report (R. 64 EPC) dated Feb. 3, 2012; EP Application No./Patent No. 10009092.7-2122/2302096.

* cited by examiner

*Primary Examiner* — Lois Zheng
(74) *Attorney, Agent, or Firm* — Studebaker & Brackett PC

(57) ABSTRACT

In a process which is before a treatment process of forming a chemical conversion, $TiO_2$ fine particles as an electron releasing-related substance (electron releasing substance) are attached onto a surface of a vehicle body. Then, a chemical conversion treatment is applied to the vehicle body having the $TiO_2$ fine particles attached thereto. Thereby, an energy band gap of a finally-formed chemical conversion film can be smaller than that of a chemical conversion film formed by using only a chemical conversion treatment agent. Accordingly, the number of electrons (free electrons) which can be supplied onto the surface of a chemical conversion film can be increased during a voltage application in an electrodeposition coating process, and reducing reaction at a cathode can be promoted.

8 Claims, 24 Drawing Sheets

FIG. 17

Absorption Process

| $TiO_2$ Colloid (ppm) | Coating-Film Thickness with 30V applied (μm) | Swelling Rate (%) of Coating Film after 60 cycles of CCTs |
|---|---|---|
| 0 | 2 | 23 |
| 5 | 2.1 | 25 |
| 10 | 2.8 | 25 |
| 50 | 4.2 | 25 |
| 200 | 4.5 | 30 |
| 500 | 5.3 | 30 |
| 1000 | 7.5 | 50 |

pH=9, Bath Tempt.=30 ºC

FIG. 24

| Semiconductor Fine Particles (wt%) | Coating-Film Thickness with 30V applied (μm) | Swelling Rate (%) of Coating Film after 60 cycles of CCTs |
|---|---|---|
| 0 | 2 | 32 |
| 3.2 | 3 | 20 |
| 5.6 | 3.5 | 17 |
| 7.7 | 4.5 | 28 |
| 11.3 | 6 | 45 |

Absorption Process

| Cu Ion (ppm) | Coating-Film Thickness with 30V applied (μm) | Swelling Rate (%) of Coating Film after 60 cycles of CCTs |
|---|---|---|
| 0 | 2 | 23 |
| 5 | 3.1 | 25 |
| 10 | 4.4 | 20 |
| 50 | 4.7 | 20 |
| 200 | 5.9 | 25 |
| 500 | 4.6 | 30 |
| 1000 | 2.8 | 45 |

pH=3, Bath Tempt.=30 ºC

SURFACE TREATMENT METHOD OF METAL MATERIAL

BACKGROUND OF THE INVENTION

The present invention relates to a surface treatment method of a metal material which is used as a process before an electrodeposition coating process.

In a coating process of automotive vehicles or the like, a chemical conversion treatment is generally applied to a workpiece to be coated (metal material) before a cationic electrodeposition coating. In this chemical conversion treatment, a zinc phosphate-based treatment agent comprising a primary component of zinc phosphate is often used as a chemical conversion treatment agent. The workpiece subjected to the chemical conversion treatment using the zinc phosphate-based treatment agent can obtain excellent electrodeposition coatability (excellent film thickness characteristic of a coating film) in the cationic electrodeposition coating process. However, the zinc phosphate-based treatment agent has a problem in that phosphate ions thereof may cause eutrophication. Moreover, the chemical conversion treatment using the zinc phosphate-based treatment agent may cause a problem of production of sludge to be wasted. With a view to solving these problems, there has been proposed the chemical conversion treatment agent which comprises: at least one selected from the group consisting of zirconium, titanium and hafnium; fluorine; and a water-soluble resin, as disclosed in U.S. Pat. No. 7,510,612, for example.

However, in case a workpiece is subjected to a chemical conversion treatment using a chemical conversion agent comprising a primary component of zirconium (zirconium compound) or the like, a chemical conversion film ($ZrO_2$ or the like), which has a relatively small number of local low-resistance areas i.e., a relatively low electrical conductivity, compared with a chemical conversion film formed using the zinc phosphate-based treatment agent, is formed on a surface of the workpiece. Accordingly, in an electrodeposition coating process, a relatively high voltage is applied between an anode and a portion of the workpiece adjacent to the anode (an outer panel of a vehicle body), whereas a relatively low voltage is applied between the anode and another portion of the workpiece far from the anode (an inner panel of the vehicle body), as a phenomenon specific to the electrodeposition coating process. Herein, the deposition amount of coating film may decrease in the portion of the workpiece far from the anode which belongs to a low voltage-applied region. Thus, in case the chemical conversion agent comprising the primary component of zirconium (zirconium compound) or the like is used, the deposition amount of coating film may improperly decrease in the portion of the workpiece far from the anode (the inner panel of the vehicle body) which belongs to the low voltage-applied region, compared with a case of the zinc phosphate-based treatment agent being used (see FIG. 3).

SUMMARY OF THE INVENTION

The present invention has been devised in view of the above circumstances, and an object of the present invention is to provide a surface treatment method of a metal material which can properly improve the electrodeposition coatability in a portion of a workpiece which belongs to a low voltage-applied region, even if any chemical conversion agent which forms a chemical conversion film having a relatively small number of local low-resistance areas is used.

According to the present invention, there is provided a surface treatment method of a metal material, comprising attaching an electron releasing-related substance onto a surface of the metal material in an adsorption process, and applying a chemical conversion treatment to the metal material having the electron releasing-related substance attached thereto, using a chemical conversion treatment agent, in a chemical conversion process which is provided before an electrodeposition coating process such that an energy band gap of a finally-formed chemical conversion film is smaller than that of a chemical conversion film formed by using only the chemical conversion treatment agent.

According to the present invention, even if the chemical conversion treatment agent which forms the chemical conversion film having a small number of local low-resistance areas is used, the electron releasing-related substance is attached onto the surface of the metal material, and the chemical conversion treatment is applied to the metal material having the electron releasing-related substance attached thereto, using the chemical conversion treatment agent, before the electrodeposition coating process such that the energy band gap of the finally-formed chemical conversion film is smaller than that of the chemical conversion film formed by using only the chemical conversion treatment agent. Thereby, the number of electrons (free electrons) which can be supplied onto the surface of the chemical conversion film can be increased during a voltage application in the electrodeposition coating process, so that the number of local electrical-conductive areas can be increased in the chemical conversion film (i.e., promotion of reducing reaction of $H_2O$). Accordingly, even if the chemical conversion treatment agent which forms the chemical conversion film having the small number of local low-resistance areas is used, deposition of a coating film is promoted, so that the electrodeposition coatability of a portion of a workpiece (metal material) to be coated which belongs to a low voltage-applied region can be improved. Further, since attaching the electron releasing-related substance onto the surface of the metal material is conducted before the treatment of forming the chemical conversion film, a process control of the treatment of forming the chemical conversion film (e.g., bathing stability, deposition speed of a film) can be further facilitated, compared with a case of using the electron releasing-related substance which is contained in the chemical conversion treatment agent.

According to an embodiment of the present invention, an electron releasing substance to make the energy band gap of the finally-formed chemical conversion film be smaller than that of the chemical conversion film formed by using only the chemical conversion treatment agent is used as the electron releasing-related substance so that the finally-formed chemical conversion film can be the chemical conversion film formed by using only the chemical conversion treatment agent which contains the electron releasing substance. Thereby, the number of free electrons which can be supplied onto the surface of the chemical conversion film can be increased based on the electron releasing substance in the chemical conversion film during the voltage application in the electrodeposition coating process, so that the number of local electrical-conductive areas can be increased in the chemical conversion film. Accordingly, even if the chemical conversion treatment agent which forms the chemical conversion film having the small number of local low-resistance areas is used, the deposition of the coating film is promoted, so that the electrodeposition coatability of the portion of the workpiece to be coated which belongs to the low voltage-applied region can be improved.

According to another embodiment of the present invention, at least one kind of metal fine particles, n-type semiconductor fine particles, genuine semiconductor fine particles, electrically conductive organic fine particles, and electrical insulator fine particles is used as the electron releasing substance. Thereby, increase of the number of free electrons can be achieved by using the above-described concrete electron releasing substance, so that the number of local electrical-conductive areas can be increased in the chemical conversion film (i.e., promotion of creating phosphate ions for deposition of a coating film).

According to another embodiment of the present invention, the electron releasing substance is titanous oxide which excites an electron by applying an energy exceeding a specified energy band gap. Herein, there occurs no any problem in terms of the function of the chemical conversion film, and the increase of the number of free electrons can be achieved by using properties of the titanous oxide (i.e., having a smaller (lower) energy band gap than the chemical conversion film), so that the number of local electrical-conductive areas can be increased in the chemical conversion film (i.e., promotion of creating phosphate ions for deposition of a coating film).

According to another embodiment of the present invention, a compound having at least one selected from a group consisting of Zr, Ti, Hf and Si as a primary component is used as the chemical conversion treatment agent so that the chemical conversion film can be an oxide compound having at least one selected from the group consisting of Zr, Ti, Hf and Si. Thereby, even if the chemical conversion treatment agent which forms the chemical conversion film having the small number of local low-resistance areas is used, the number of electrons (free electrons) which can be supplied onto the surface of the chemical conversion film can be increased during the voltage application in the electrodeposition coating process, so that the number of local electrical-conductive areas can be increased in the chemical conversion film (i.e., promotion of reducing reaction of $H_2O$). Accordingly, decrease of the amount of deposition of the coating film can be suppressed in the portion of the workpiece to be coated which belongs to the low voltage-applied region. Further, eutrophication can be prevented, production of waste sludge associated can be suppressed, and corrosion resistance can be obtained based on the properties of the chemical conversion film.

According to another embodiment of the present invention, titanous oxide which excites an electron by applying an energy exceeding a specified energy band gap is used as the electron releasing substance, a compound having at least one selected from a group consisting of Zr, Ti, Hf and Si as a primary component is used as the chemical conversion treatment agent so that the chemical conversion film can be an oxide compound having at least one selected from the group consisting of Zr, Ti, Hf and Si, and the metal material is immersed in a treatment solution in which fine particles of the titanous oxide are in a dispersed state with a density of 10 to 500 ppm in case of attaching the titanous oxide onto the surface of the metal material. Thereby, the electrodeposition coatability of the portion of the workpiece to be coated which belongs to the low voltage-applied region can be improved based on the titanous oxide, and also deterioration of the corrosion resistance lowering below an allowable limit can be surely prevented based on containment of fine particles of the titanous oxide.

According to another embodiment of the present invention, a protective colloid is used in case of making the fine particles of the titanous oxide in the dispersed state in the treatment solution. Thereby, the fine particles of the titanous oxide can be properly made in the dispersed state in the treatment solution.

According to another embodiment of the present invention, a doping treatment of the electron releasing-related substance is applied to the chemical conversion film formed by using only the chemical conversion treatment agent before the electrodeposition coating process so that the finally-formed chemical conversion film can be a n-type semiconductor having surplus electrons. Thereby, the number of free electrons which can be supplied onto the surface of the chemical conversion film can be increased during the voltage application in the electrodeposition coating process, so that the number of local electrical-conductive areas can be increased in the chemical conversion film (i.e., promotion of reducing reaction of $H_2O$). Accordingly, even in this case, the deposition of the coating film can be promoted, and the electrodeposition coatability of the portion of the workpiece to be coated which belongs to the low voltage-applied region can be improved.

According to another embodiment of the present invention, a substance having a greater electric charge number than the chemical conversion film is used the electron releasing-related substance in case of applying the doping treatment, and a heating treatment is applied to the chemical conversion film formed by using only the chemical conversion treatment agent and the electron releasing-related substance in the chemical conversion film after the treatment of forming the chemical conversion film. Thereby, the n-type semiconductor of the chemical conversion film can be properly formed before the electrodeposition coating process, and effects according to the right above embodiment can be surely obtained.

Further, according to another aspect of the present invention, there is provided a surface treatment method of a metal material, comprising attaching an electrically conductive substance onto the metal material in an adsorption process so as to form an uneven surface of the metal material, and applying a chemical conversion treatment to the metal material having the uneven surface, using a chemical conversion treatment agent, such that a thickness of a portion of a chemical conversion film between adjacent convex portions of the electrically conductive substance is smaller than that of the other portion of the chemical conversion film.

According to the above-described aspect of the present invention, even if the chemical conversion treatment agent which forms the chemical conversion film having a small number of local low-resistance areas is used, the electrically conductive substance is attached onto the metal material so as to form the uneven surface of the metal material, and the chemical conversion treatment is applied to the metal material having the uneven surface, using the chemical conversion treatment agent, such that the thickness of the portion of the chemical conversion film between adjacent convex portions of the electrically conductive substance is smaller than that of the other portion of the chemical conversion film. Thereby, respective thin film portions (i.e., respective portions of the chemical conversion film between adjacent convex portions of the electrically conductive substance) can be local low-resistance areas, so that electrical conduction can be facilitated with the thin film portions during the voltage application in the electrodeposition coating process. Accordingly, even if the chemical conversion treatment agent which forms the chemical conversion film having the small number of local low-resistance areas is used, deposition of a coating film is promoted, so that the electrodeposition coatability of the portion of the workpiece (metal material) to be coated which belongs to the low voltage-applied region can be improved.

According to another embodiment of the present invention, the electrically conductive substance is a substance which has an ionization tendency which is smaller than that of a component of the metal material, and the attaching of the electrically conductive substance onto the metal material comprises a treatment in which the metal material is immersed in a treatment solution which contains the electrically conductive substance in an ion state so as to have the electrically conductive substance deposited on a surface of the metal material, whereby the uneven surface of the metal material can be formed. Thereby, the surface of the metal material can be properly formed in the uneven state by utilizing difference in the ionization tendency between the electrically conductive substance and the component of the metal material in the immersion treatment. Accordingly, the portion of the chemical conversion film between adjacent convex portions of the electrically conductive substance can be made properly thin in the subsequent treatment of forming the chemical conversion film, so that the thin film portions can be the local low-resistance areas (local electrical-conductive areas). Thus, the electrodeposition coatability of the portion of the workpiece (metal material) to be coated which belongs to the low voltage-applied region can be improved.

According to another embodiment of the present invention, the electrically conductive substance is a metal. Thereby, the effects of the above-described embodiment can be obtained properly.

According to another embodiment of the present invention, the metal is copper, and the metal material is immersed in a treatment solution which has a density of copper ion of 5 to 500 ppm to have the copper deposited on the surface thereof. Thereby, the electrodeposition coatability of the portion of the workpiece to be coated which belongs to the low voltage-applied region can be improved based on the copper, and also deterioration of the corrosion resistance lowering below an allowable limit can be surely prevented based on containment of the copper.

Other features, aspects, and advantages of the present invention will become apparent from the following description which refers to the accompanying drawings.

BRIEF DESCRIPTION OF THE DRAWINGS

FIG. 17 is a table showing influence of density of $TiO_2$ fine particles, ($TiO_2$ colloid) in a treatment solution in an adsorption process on the coating-film thickness (electrodeposition characteristic) and the corrosion resistance.

FIG. 24 is a table showing influence of a content ratio of n-type ZnO (semiconductor fine particles) to the $ZrO_2$ film containing n-type ZnO, on a coating-film thickness characteristic (electrodeposition coatability) and corrosion resistance.

DETAILED DESCRIPTION OF THE INVENTION

Hereinafter, preferred embodiments of the present invention will be described taking examples of a vehicle body (a workpiece to be coated) as a metal material, referring to the accompanying drawings.

Embodiment 1

Figure 1:
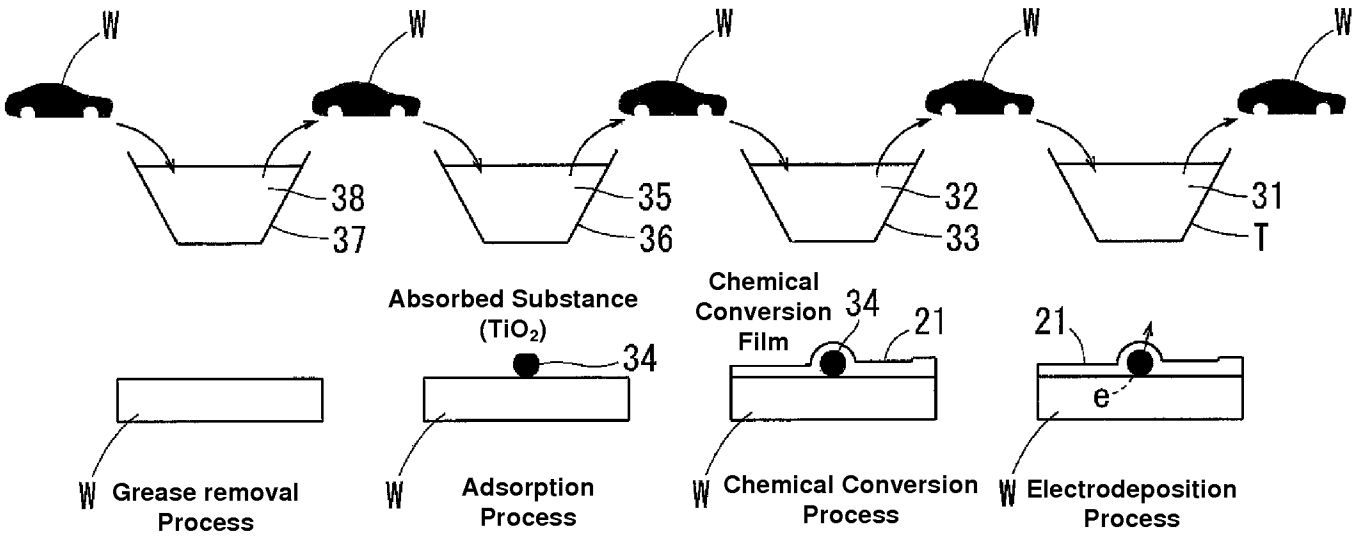
FIG. 1 is a process diagram showing manufacturing processes according to a first embodiment of the present invention.
Figure 2:
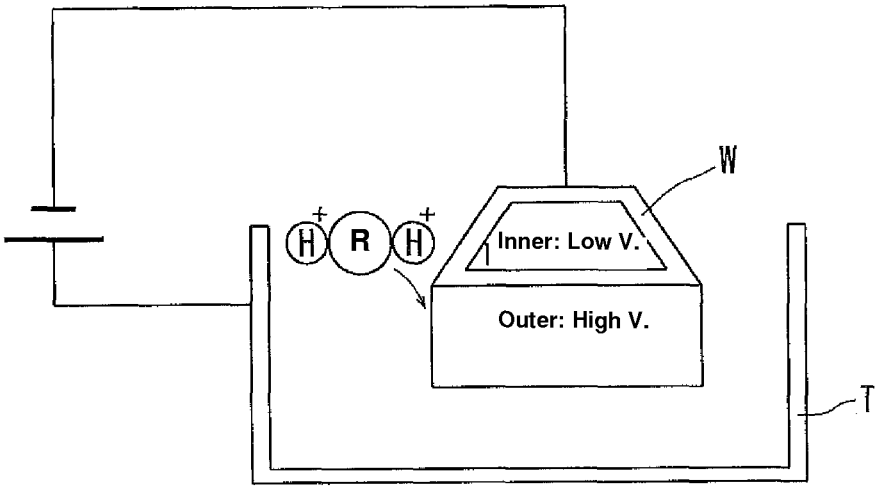
FIG. 2 is an explanatory diagram showing an electrodeposition coating process.

In a coating process of a vehicle body W of automotive vehicles or the like, as shown in FIGS. 1 and 2, an electrodeposition coating process is applied as a final one. This electrodeposition coating process is a process of a cationic electrodeposition coating (undercoating) being applied to the vehicle body W, where the vehicle body W is immersed in a cationic electrodeposition coating material contained in a tank T (for the period of time 180 sec. for example), and then a voltage is applied between the tank T and the vehicle body W under a condition that the tank T and the workpiece W are set as an anode and a cathode, respectively. As a result, a coating film (not illustrated in FIG. 1) is deposited on the surface of the workpiece W.

A chemical conversion film forming treatment (hereinafter, referred to as "chemical conversion process") is applied before the above-described electrodeposition coating process in the coating of the vehicle body W as shown in FIG. 1. This is because the electrodeposition coating film can be improved in terms of electrodeposition coatability, adhesion, corrosion resistance and the like by a chemical conversion film formed through the chemical conversion film forming treatment. Thus, in the chemical conversion process, a tank 33 for chemical conversion treatment which is filled with a chemical conversion treatment agent 32 is prepared, and the vehicle body W is immersed in the chemical conversion treatment agent 32.

The chemical conversion treatment agent 32 contains a compound having at least one selected from the group consisting of Zr, Ti, Hf and Si, as a primary component, and further contains fluorine (an etching agent) and a water-soluble resin, as a secondary component. This is because a chemical coversion film 21 which contains an oxide compound having at least one selected from the group consisting of Zr, Ti, Hf and Si as the primary component is formed on the surface of the vehicle body W immersed in the chemical conversion treatment agent 32, so that eutrophication can be prevented and production of waste sludge associated with the chemical conversion treatment can be suppressed as well as the corrosion resistance and the like can be ensured. More specifically, there has heretofore been known a zinc phosphate film formed using a zinc phosphate-based treatment agent, as a chemical conversion film excellent in the corrosion resistance, the adhesion of a coating film, and the like. However, the use of the zinc phosphate-based treatment agent to form the zinc phosphate film involves problems that phosphate ions of the zinc phosphate-based treatment agent cause the eutrophication, and the waste sludge is produced along with the chemical conversion treatment. Therefore, the above-described chemical conversion treatment agent 32 is used to avoid the above-described problems.

In the present embodiment, $H_2ZrF_6$ of a zirconium compound is used as the primary component of the chemical conversion treatment agent 32, and the vehicle body W is immersed in the chemical conversion treatment agent 32 for the period of time 180 sec., so that the chemical conversion film (hereinafter, referred to as "$ZrO_2$ film") 21 comprising a primary component of a zirconium oxide (hereinafter, expressed as "$ZrO_2$") is formed on the surface of the vehicle body W. More specifically about forming this $ZrO_2$ film, the chemical conversion treatment agent contains HF as the primary component and $H_2ZrF_6$ as the secondary component, and these are in a chemically-balanced state as expressed in the following reaction formulas (1) and (2).

$$HF \leftrightarrows H^+ + F^- \quad \text{(Reaction formula 1)}$$

$$H_2ZrF_6 + 2H_2O \leftrightarrows ZrO_2 + 6HF \quad \text{(Reaction formula 2)}$$

In case the vehicle body W is immersed in the chemical conversion treatment agent 32 in this state, an anode reaction expressed in the following reaction formula (3) occurs, so that electrons are released in accordance with ionization of Fe (vehicle body). This release of electrons causes a cathode reaction expressed in the flowing reaction formula (4), so that the density of HF in the chemical conversion treatment agent decreases. Accordingly, a chemical reaction in a direction of promoting generation of HF progresses as expressed in the following reaction formula (5). Therefore, the generation of $ZrO_2$ is promoted and thereby the $ZrO_2$ film is formed.

$$Fe \rightarrow Fe^{2+} + 2e^- \quad \text{(Reaction formula 3)}$$

$$2HF + 2e^- \rightarrow H_2 + 2F^- \quad \text{(Reaction formula 4)}$$

$$H_2ZrF_6 + 2H_2O \rightarrow ZrO_2 + 6HF \quad \text{(Reaction formula 5)}$$

Meanwhile, in case the chemical conversion film 21, such as the above-described $ZrO_2$, film is used, the chemical conversion film 21 may have a relatively small number of local low-resistance areas (areas with the volume resistivity less than 1000 (Ω·cm)), compared with a chemical conversion film formed using the zinc phosphate-based treatment agent. Accordingly, in the voltage application of the electrodeposition coating process, the number of electrons (free electrons) which can be supplied onto the surface of the chemical conversion film 21 may be relatively small (the number of local electrical-conductive areas may be decreased). Consequently, the deposition amount of coating film may decrease.

Figure 3:
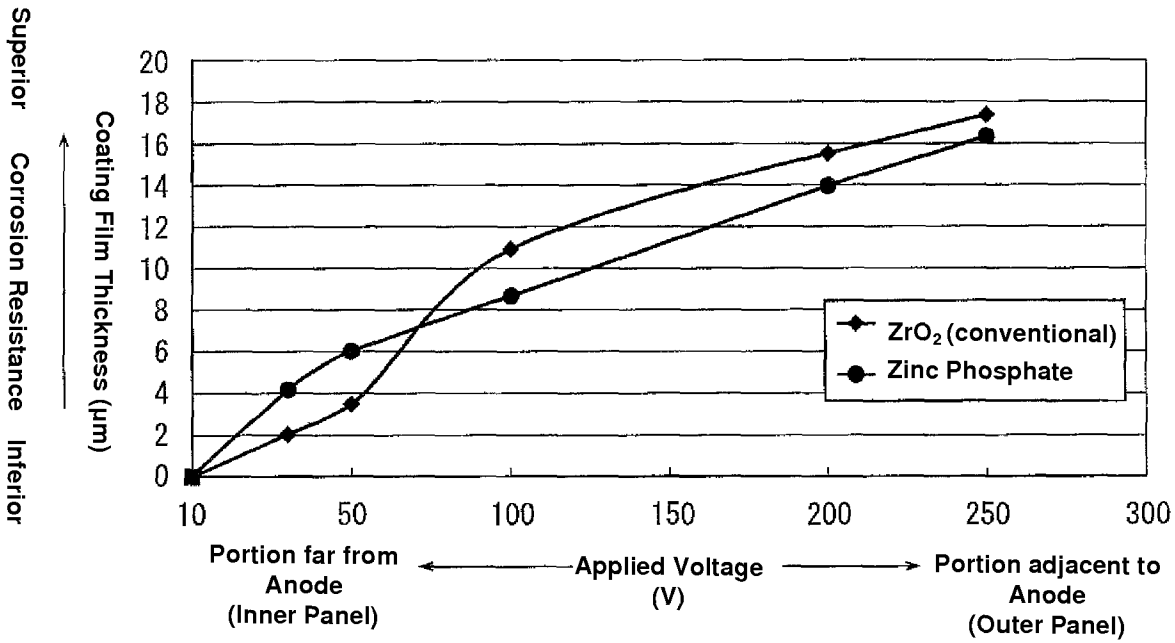
FIG. 3 is a graph showing a coating-film thickness characteristic of a $ZrO_2$ film and a zinc phosphate film.

Hereinafter, the present invention will be more specifically taking an example of the $ZrO_2$ film 21. In the electrodeposition coating process, as one characteristic thereof, a relatively high voltage is applied between the anode (in FIG. 2, the tank T) and a portion of an outer panel of the vehicle body W adjacent to the anode, whereas a relatively low voltage is applied between the anode and a portion of an inner panel of the vehicle body W far from the anode, as shown in FIG. 2. Thus, deposition of an electrodeposition coating film is initiated from the portion of the vehicle body W adjacent to the anode. The deposited coating film has electrical insulation properties, and therefore the electrical resistance of the deposited coating film becomes higher as the amount (thickness) of the deposited coating film is increased along with progress of the deposition of the coating film. Consequently, the deposition of the coating film onto the portion having the deposited coating film is gradually reduced, and instead deposition of the coating film onto a portion having no deposited coating film is initiated. During a course of the electrodeposition coating process, as shown in FIG. 3, if the $ZrO_2$ film (film not containing $TiO_2$ fine particles described below) is formed on the surface of the vehicle body (e.g., cold-rolled steel sheet), the film thickness of the electrodeposition coating film is liable to become excessively small in a low voltage (about zero to 70 V)-applied region, and to become excessively large in a high voltage (70 V or more)-applied region, compared with a case of the zinc phosphate film. Thus, the coating-film thickness at the outer panel of the vehicle body W adjacent to the anode which belongs to the high voltage-applied region becomes considerably larger, compared with the case of the zinc phosphate film. Meanwhile, the coating-film thickness at the inner panel of the vehicle body W far from the anode which belongs to the low voltage-applied region becomes considerably smaller, compared with the case of the zinc phosphate film. Thus, the $ZrO_2$ film is inferior in throwing power of an electrodeposition coating film to the case of the zinc phosphate film.

Through various researches on the above-described controversial phenomenon, the inventors of the present invention have obtained the following results.

Figure 4:
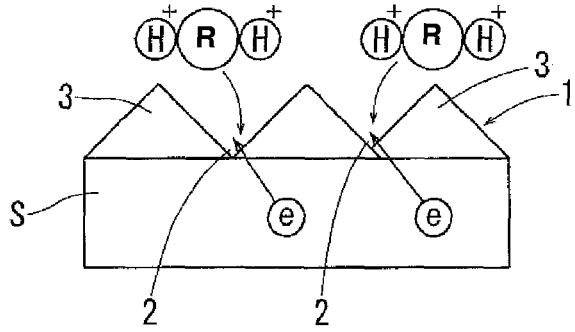
FIG. 4 is an explanatory diagram conceptually showing low-resistance areas of the zinc phosphate film.
Figure 5:
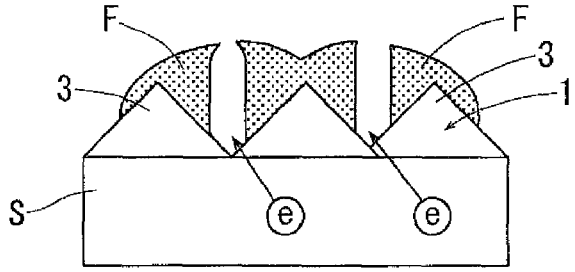
FIG. 5 is an explanatory diagram conceptually showing deposition of a coating film on the low-resistance areas of the zinc phosphate film.
Figure 9:
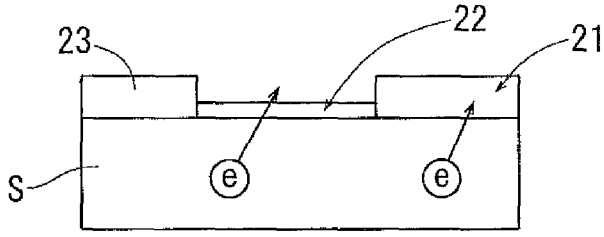
FIG. 9 is an explanatory diagram conceptually showing low-resistance areas of a $ZrO_2$ film.

(1) When the surface of a steel sheet S (a surface of the vehicle body W) is treated with the zinc phosphate-based treatment agent, a crystalline zinc phosphate film 1 having a large number of pointed-shaped portions lying side-by-side is formed to define a large number of low-resistance areas (lower regions of boundary spaces between respective adjacent ones of the pointed portions (areas with the volume resistivity less than 1000 (Ω·cm))) 2, as shown in FIG. 4. Thus, electrons transfer to each of the low-resistance areas 2, so that electrolysis occurs on the surface of the steel sheet S to generate hydroxide ions, and acid giving water solubility to a coating material is neutralized by the hydroxide ions. Based on the neutralization of the acid, a coating film F is deposited on the surface of the steel sheet S, as shown in FIG. 5. Thus, formation of the coating film F on the surface of the steel sheet S is promoted even in a portion of the vehicle body far from the anode which belongs to the low voltage-applied region. In contrast, when the steel sheet S is subjected to the chemical conversion treatment using the chemical conversion treatment agent, the $ZrO_2$ film 21 is formed as a flat continuous noncrystalline film, as shown in FIG. 9. Although a local low-resistance area 22 (area with the volume resistivity less than 1000 (Ω·cm)) is formed in the conventional $ZrO_2$ film 21, the number of the local low-resistance areas 22 is extremely small. Thus, the conventional $ZrO_2$ film 21 has a relatively low electrical conductivity, and thereby the amount of coating film to be deposited on a portion of the vehicle body W far from the anode which belongs to the low voltage-applied region becomes smaller.

Figure 10:
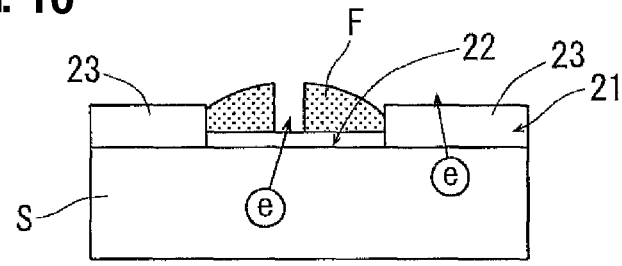
FIG. 10 is an explanatory diagram conceptually showing deposition of a coating film on the low-resistance areas of the $ZrO_2$ film.

(2) The resistance in each of the few local low-resistance areas of the conventional $ZrO_2$ film 21 is greater than that in each of the low-resistance areas 2 of the zinc phosphate film 1. Therefore, no current flows through the $ZrO_2$ film 21 unless a certain level or more of voltage is applied thereto. Thus, as shown in FIG. 10 (see FIG. 5 for comparison), the coating film F is unlikely to be deposited compared with the case of the zinc phosphate film 1.

Figure 6:
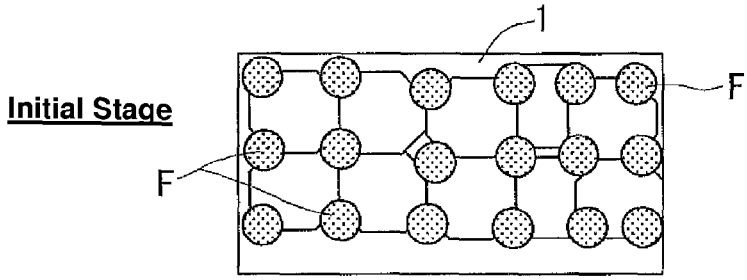
FIG. 6 is a plan view conceptually showing an initial stage of the deposition of the coating film on the low-resistance areas of the zinc phosphate film.
Figure 7:
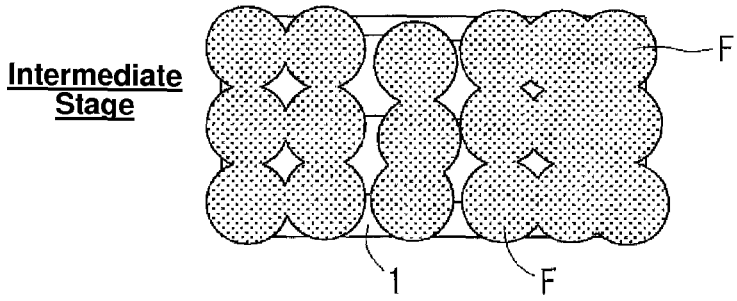
FIG. 7 is a plan view conceptually showing an intermediate stage of the deposition of the coating film on the low-resistance areas of the zinc phosphate film.
Figure 11:
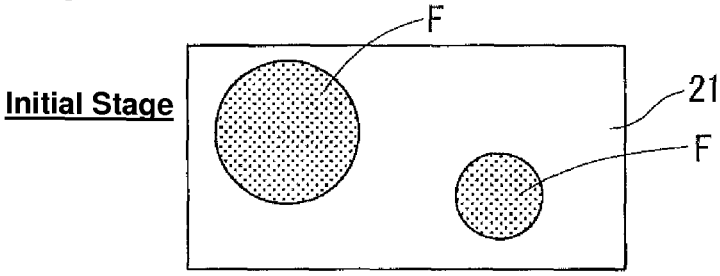
FIG. 11 is a plan view conceptually showing an initial stage of the deposition of the coating film on the low-resistance areas of the $ZrO_2$ film.
Figure 12:
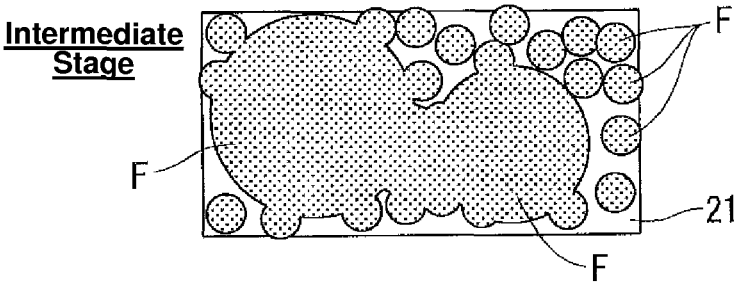
FIG. 12 is a plan view conceptually showing an intermediate stage of the deposition of the coating film on the low-resistance areas of the $ZrO_2$ film.

(3) Further, the resistance in a maximum-resistance area (an area having a maximum film thickness of about 50 nm: see FIG. 9) 23 of the conventional $ZrO_2$ film 21 is less than that in a maximum-resistance area (a pointed area having a maximum film thickness of about 1 to 2 μm: see FIG. 4) 3. Therefore, in the high voltage-applied region, the coating film F is more widely deposited on the $ZrO_2$ film 21 than on the zinc phosphate film 1. Thus, in a portion of the outer panel of the vehicle body W adjacent to the anode which belongs to the high voltage-applied region, the film thickness of the coating film F becomes considerably greater than that of the case of the zinc phosphate film 1. FIGS. 6, 7, 11 and 12 conceptually show the above-described content. Specifically, FIG. 6 is an explanatory diagram conceptually showing an initial stage of deposition of the coating film of the zinc phosphate film 1 in the high voltage-applied region, and FIG. 7 is an explanatory diagram conceptually showing an intermediate stage of the deposition of the coating film of the zinc phosphate film 1 in the high voltage-applied region. FIG. 11 is an explanatory diagram conceptually showing an initial stage of deposition of the coating film of the conventional $ZrO_2$ film 21 in the high voltage-applied region, and FIG. 12 is an explanatory diagram conceptually showing an intermediate stage of the deposition of the coating film of the conventional $ZrO_2$ film 21 in the high voltage-applied region.

Figure 8:
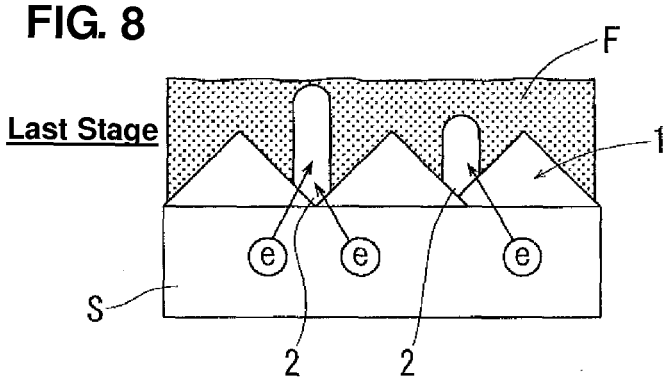
FIG. 8 is a front view conceptually showing a last stage of the deposition of the coating film on the low-resistance areas of the zinc phosphate film.
Figure 13:
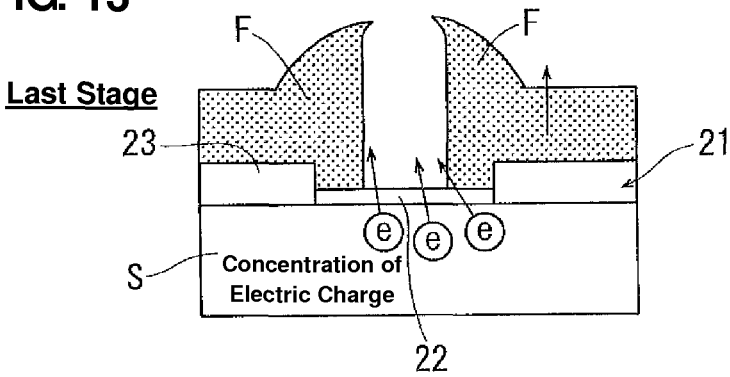
FIG. 13 is a front view conceptually showing a last stage of the deposition of the coating film on the low-resistance areas of the $ZrO_2$ film.

(4) The size (spatial size) of each of the low-resistance areas 2 of the zinc phosphate film 1 is relatively small. Thus, electrolysis occurs in each of the low-resistance areas 2 to generate hydroxide ions, and acid giving water solubility to paint is neutralized by the hydroxide ions. Then, when the coating film F is deposited, (the space of) each of the low-resistance areas 2 is easily filled with the coating film F, as shown in FIG. 8. In contrast, each of the few low-resistance areas 22 of the conventional $ZrO_2$ film 21 is thinner and larger (wider) than the low-resistance area 2 of the zinc phosphate film 1. Thus, although a coating film F is deposited through concentration of electric charges in the large low-resistance area 22 and neutralization of acid giving water solubility to paint by the hydroxide ions, the large low-resistance area 22 is not easily filled with the coating film F, as shown in FIG. 13. Therefore, the resistance is not increased along with the deposition of the coating film on the steel sheet S to allow the coating film F to be continuously deposited, so that the film thickness of the coating film F at the outer panel of the vehicle body W adjacent to the anode becomes fairly greater than that of the case of the zinc phosphate film 1. This makes it difficult to allow electrons to transfer to the inner panel of the vehicle body W far from the anode to which electrons essentially hardly transfer, and thereby no coating film F is deposited thereon.

Based on the above-described results, as shown in FIG. 1, an adsorption process is provided after a grease removal process (where the vehicle body W is immersed in a grease removing solution 38 contained in a grease removal tank 37 for a period of time 180 sec., for example, to remove grease, dust and the like which are attached onto the vehicle body W) and before the above-described chemical conversion process. In this adsorption process, an electron releasing substance 34 is adsorbed in (attached onto) the vehicle body W, which makes an energy band gap (hereinafter, referred to as "band gap") of a finally-formed chemical conversion film be smaller than that of the chemical conversion film 21 formed by using only the chemical conversion treatment agent 32. The reason for this is to prevent the above-described problems (inferiority in throwing power of the coating film etc.) by making the band gap of the finally-formed chemical conversion film (containing the electron releasing substance 34) be smaller than that of the chemical conversion film 21, such as the $ZrO_2$ film, which is formed by using only the chemical conversion treatment agent 32 in the subsequent process. Specifically, the basic functions, such as the corrosion resistance, are ensured by the properties of the chemical conversion film 21 occupying its most part (with an extremely small amount of electron releasing substance 34), an excessive deposition of the coating film F onto the outer panel of the vehicle body W adjacent to the anode is suppressed by a relative decrease of the ratio of the chemical conversion component based on containment of the electron releasing substance 34 in the chemical conversion film 21, and the deposition of the coating film F on the inner panel of the vehicle body W far from the anode is promoted by an increase of the free electrons directed to the surface of the chemical conversion film 21 on the vehicle body W (i.e., an increase of the number of electrical-conductive areas) based on containment of the electron releasing substance 34 (with the small band gap) in the chemical conversion film 21 (in the voltage application of the electrodeposition coating process). Thus, the improvement of the electrodeposition coatability on the inner panel of the vehicle body W far from the anode in the low voltage-applied region is aimed.

Therefore, a tank for adsorption treatment 36 which is filled with a treatment solution 35 which contains the electron releasing substance 34 in a dispersed state is provided to adsorb the electron releasing substance 34 into the vehicle body W in the adsorption process. The vehicle body W is immersed in the treatment solution 35. At least one kind of the metal fine particles, n-type semiconductor fine particles, genuine semiconductor fine particles, electrically conductive organic fine particles, and electrical insulator fine particles is used as the above-described electron releasing substance 34. Each band gap of these fine particles is smaller than that ($ZrO_2$: about 5 to 8 eV) of the chemical conversion film 21. Specifically, Mg, Al, Ca, Co, Ni, Cu, Zn or the like (the band gap: zero eV) is preferably used as the metal fine particles, and the n-type ZnO or the like (the band gap: about 2 eV or less) is preferably used as the n-type semiconductor fine particles. Further, fine particles which protect polyaniline, metal with the organism or the like (the band gap: almost zero eV) is preferably used as the electrically conductive organic fine particles, and oxide compound, such as ZnO or $TiO_2$, (the band gap: 2 to 3 eV) is preferably used as the electrical insulator fine particles. Herein, the average particle size of these fine particles of 100 nm or less is preferable, and especially the average particle size of 20 to 50 nm is more preferable.

In the present embodiment, the fine particles of titanous oxide ($TiO_2$) as the electrical insulator fine particles are used as the above-described electron releasing substance 34. This is because even if the $TiO_2$ fine particles adsorbed into the vehicle body W in the adsorption process are used, there occurs no any problem in the chemical conversion film 21 formed in the subsequent chemical conversion process in terms of the corrosion resistance of the chemical film and the like. Further, in the voltage application in the electrodeposition coating process, the electrons are positively excited based on the properties of the $TiO_2$ fine particles having the band gap (3.0 to 3.2 eV) which is smaller than that (about 5 eV) of the $ZrO_2$ film 21, so that the number of the free electrons can be increased (i.e., the number of the local low-resistance areas in the chemical conversion film can be increased). Thus, promotion of the hydroxide ions for the coating-film deposition can be achieved. Therefore, the treatment solution 35 contained in the adsorption treatment tank 36 is set to have 6 to 10 pH, the temperature of 10 to 40° C., and the $TiO_2$ fine particles are immersed in this treatment solution 35 with the density of 10 to 500 ppm (i.e., $TiO_2$ colloid density which will be described below). Herein, the protective colloid (i.e., hydrophile colloid) is used in order to maintain the dispersed state of the $TiO_2$ fine particles in the treatment solution 35, and hydroxyethyl methacrylate is used as the protective colloid in the present embodiment. A mass ratio of this protective collide to the $TiO_2$ fine particles is set to be that the protective collide: the $TiO_2$ fine particles=1:9. Even though the protective colloid is used for the dispersion of the $TiO_2$ fine particles (hereinafter, the $TiO_2$ fine particles with the protective colloid attached thereto will be referred to as "$TiO_2$ colloid"), the density of that (hereinafter, referred to as "$TiO_2$ colloid density") substantially shows the density of the $TiO_2$ fine particles.

Further, it is set that the vehicle body W is immersed in the treatment solution 35 of the adsorption treatment tank 36 for a period of time of 10 to 600 sec. (30 sec. in the present embodiment) in the adsorption process, so that a specified amount of $TiO_2$ fine particles is adsorbed into the vehicle body W. A covalent bond is utilized between the $TiO_2$ fine particles and the vehicle body W for this adsorption, and therefore the $TiO_2$ fine particles may not be released off the vehicle body W when the vehicle body W is immersed in the chemical conversion treatment tank 33 in the subsequent chemical conversion process.

Thereby, the $ZrO_2$ film 21 containing the $TiO_2$ fine particles is formed on the surface of the vehicle body W as a final chemical conversion film in the chemical conversion process following the above-described adsorption process. Thus, the coating-film thickness characteristic (electrodeposition characteristic) of that becomes similar to that of the crystalline zinc phosphate film 1. As a result, the eutrophication can be prevented and the production of waste sludge associated can be suppressed, and also the excellent corrosion resistance and electrodeposition coatability can be obtained.

Herein, in terms of the above-described problem (the film thickness of the coating film at the portion of the workpiece adjacent to the anode which belongs to the high voltage-applied region becomes fairly greater than that of the case of the zinc phosphate film, whereas the film thickness of the coating film at the portion of the workpiece far from the anode which belongs to the low voltage-applied region becomes considerably smaller than that of the case of the zinc phosphate film), it may be considered that the respective low-resistance areas 22 at the $ZrO_2$ film (not containing the metal fine particles, n-type semiconductor fine particles, genuine semiconductor fine particles, electrically conductive organic fine particles, and electrical insulator fine particles) are so decreased by some method that the electric charges do not concentrate in the respective low-resistance areas 22. In this case, however, the thickness of the film may increase, so that the deposition of the coating film may not occur unless a voltage to initiate the deposition of the coating film is increased further. In contrast, in case at least one kind of the metal fine particles, n-type semiconductor fine particles, genuine semiconductor fine particles, electrically conductive organic fine particles, and electrical insulator fine particles is contained in the $ZrO_2$ film 21, the supplied electrons increase during the voltage application (the number of electrical-conductive areas increase) regardless of the increase of the respective low-resistance areas 22. Consequently, the concentration of the electric charges in the respective low-resistance areas 22 can be avoided. Thus, the above-described problem (the coating-film thickness characteristic of the $ZrO_2$ film 21 becomes similar to that of the crystalline zinc phosphate film 1) can be avoided.

Figure 14:
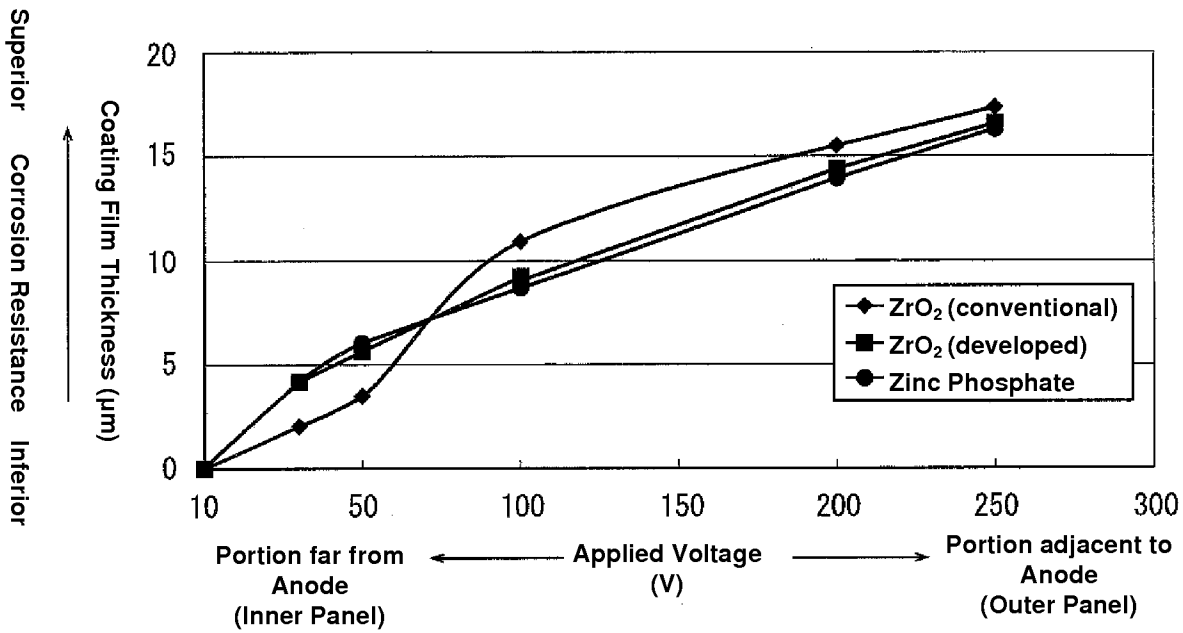
FIG. 14 is a graph showing a coating-film thickness characteristic of a $ZrO_2$ film containing $TiO_2$ fine particles, a $ZrO_2$ film, and a zinc phosphate film.

FIG. 14 shows a coating-film thickness characteristic of the $ZrO_2$ film containing the $TiO_2$ fine particles, as chemical conversion film, for the purpose of supporting the above-described contents. Herein, a test sample used a vehicle body which was immersed in the treatment solution 35 containing the Ti colloid in the adsorption process, and then it was immersed in the chemical treatment agent in the chemical conversion process. The specific test conditions were as follows:

(1) Adsorption Process $TiO_2$ colloid density ($TiO_2$: protective colloid=9:1 (mass ratio): 50 ppm pH of the treatment solution: 9

Temperature of the treatment solution: 30° C.

Immersion period of time of the test vehicle body: 30 sec.

Properties of $TiO_2$

Volume resistivity: 20 to 200 (Ω·cm)

Specific surface area: 30 to 50 ($m^2/g$)

Average particle size (primary particle size): 30 to 50 (nm)

(2) Chemical Conversion Process

Composition of the chemical treatment agent: zirconium acid $H_2ZrF_6$, fluoric acid (HF), water-soluble resin pH of the chemical conversion treatment agent: 4

Immersion period of time of the test vehicle body: 180 sec.

Temperature of the chemical conversion treatment agent (bath tempt.): 30° C.

Figure 15:
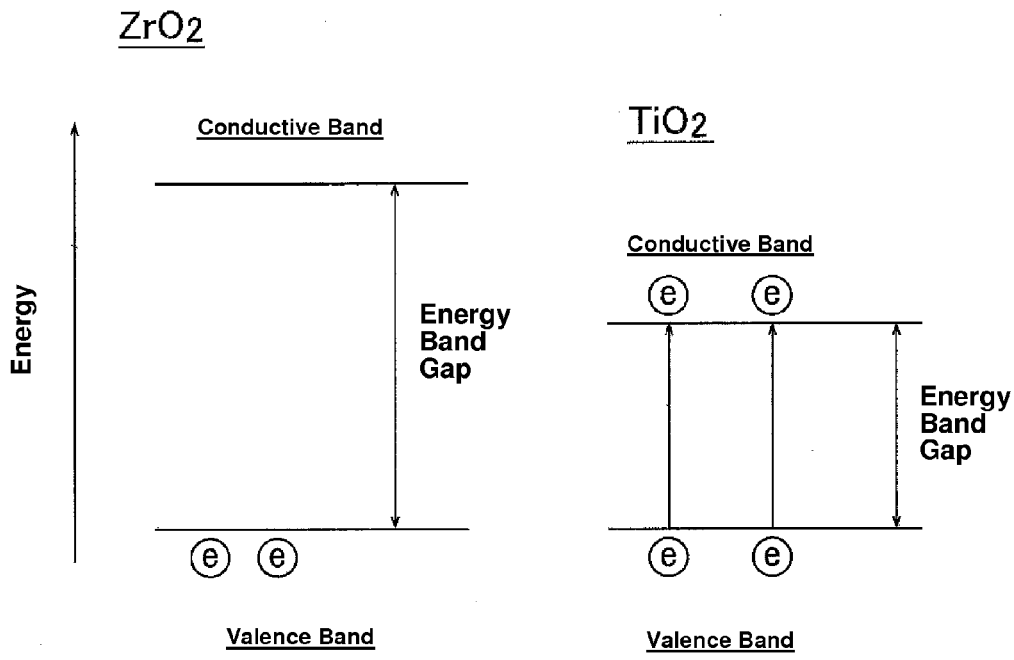
FIG. 15 is an explanatory diagram showing an energy band gap of $ZrO_2$ and an energy band gap of $TiO_2$ fine particles.
Figure 16:
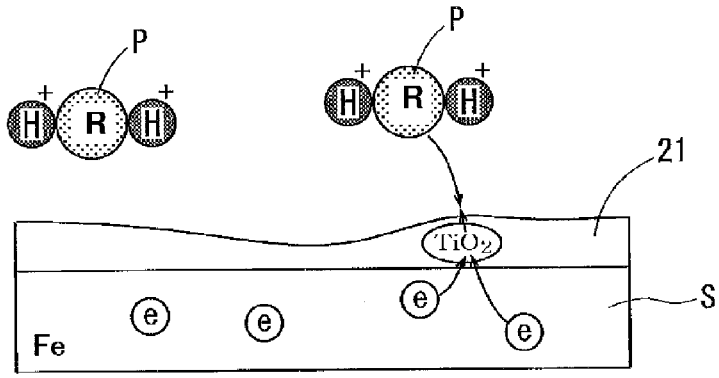
FIG. 16 is an explanatory diagram conceptually showing deposition of a coating film on the $ZrO_2$ film containing $TiO_2$ fine particles.

According to the results of FIG. 14, the coating-film thickness characteristic (electrodeposition coatability) of the $ZrO_2$ film 21 containing the $TiO_2$ fine particles (developed film) became similar to that of the zinc phosphate film 1. This is because it can be considered that in case the $ZrO_2$ film 21 containing the $TiO_2$ fine particles was used as a final chemical conversion film, the electrons were excited in the $TiO_2$ fine particles during the voltage application, and thereby the number of free electrons (local electrical-conductive areas) was increased to promote the deposition of the coating film (resin) F onto the surface of the steel sheet S, as shown in an explanatory diagram of the band gap of FIG. 15 and a conceptual diagram of FIG. 16. In this case, an applied voltage to increase the number of free electrons is preferably set at a value greater than a corrosion potential (e.g., about 1 V). In FIG. 16, reference character P denotes a coating material having water solubility given by acid.

FIG. 17 is a table showing an influence of a content ratio of the $TiO_2$ fine particles in the $ZrO_2$ film 21 containing the $TiO_2$ fine particles on the coating-film thickness (electrodeposition coatability) and the corrosion resistance. As seen in FIG. 17, the coating-film thickness becomes greater (thicker) along with an increase in the density of the $TiO_2$ colloid (i.e., the substantial $TiO_2$ fine particle density (ppm)) in the treatment solution in the adsorption process, and a problem about the corrosion resistance occurs when the density (ppm) of the $TiO_2$ colloid is increased up to a specified value or more although the corrosion resistance is in an allowable range when the amount is less than the specified value. Herein, it was set in any case of the respective treatment solutions 35 in the adsorption process that the immersion period of time of the vehicle body W in the adsorption treatment tank 36 was 30 sec., the temperature of the treatment agent in the adsorption treatment tank (bath tempt.) was 30° C., and pH of the treatment solution was 9. Further, the corrosion resistance was evaluated based on measurement of a swelling rate (%) of the coating film F after 60 cycles of cyclic corrosion tests (CCTs) (1 cycle of the CCT is approximately equal to 3 cycles of JIS K5600-7-9 cycle A).

Figure 18:
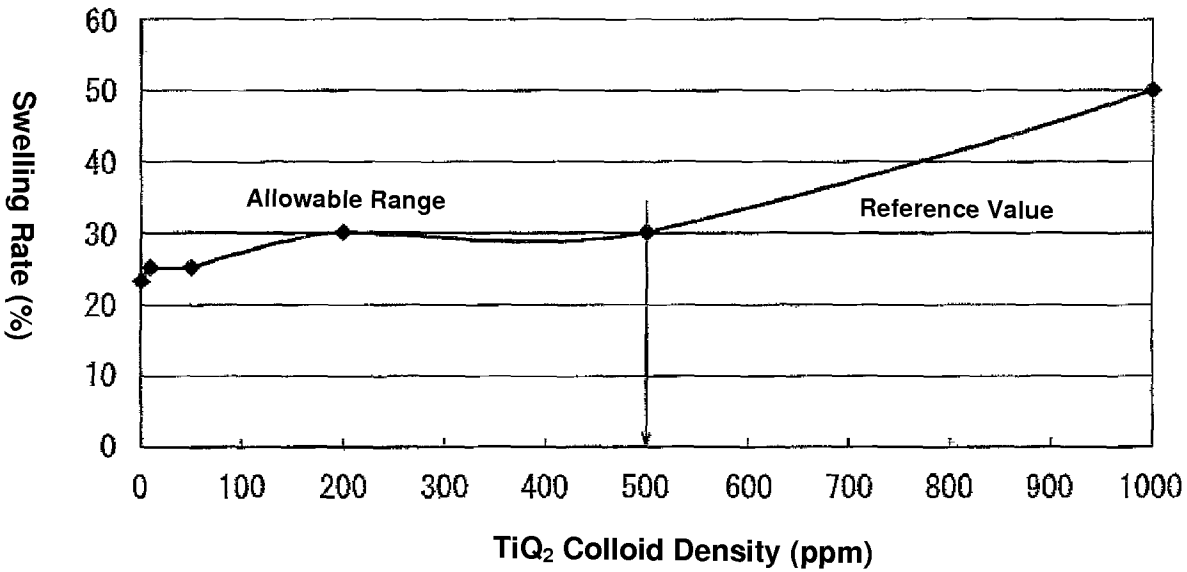
FIG. 18 is an explanatory graph showing a technique of determining an upper limit of the density of the $TiO_2$ colloid (ppm) in view of corrosion resistance.

FIG. 18 shows a technique of determining an upper limit of the density of the $TiO_2$ colloid (ppm) in view of the corrosion resistance. That is, the relationship between the $TiO_2$ colloid density (ppm) and the coating-film F swelling rate (%) after 60 cycles of the CCTs in FIG. 17 is plotted in FIG. 18, and the upper limit of the $TiO_2$ colloid density (ppm) is determined based on a coating-film swelling rate of 30(%) which is used as an allowable limit (reference value) of the corrosion resistance. In this case, the coating-film swelling rate of 30(%) is used as the allowable limit (reference value) of the corrosion resistance. This is based on the following reason. A 12-year warranty against a rust hole of the outer panel of the vehicle body becomes mainstream, and it has been confirmed by past records that the warranty is satisfied when the coating-film swelling rate is less than 30(%). Herein, 1 cycle of the CCT is approximately equal to 3 cycles of JIS K5600-7-9 cycle A.

According to FIG. 18, the density of the $TiO_2$ colloid in the solution in the adsorption process at the allowable limit of corrosion resistance is 500 ppm. That is, it is necessary to set the $TiO_2$ colloid density at 500 ppm or less in order to ensure the corrosion resistance. Meanwhile, with respect to a lower limit, is necessary to set that at 10 ppm or more in order to ensure the coating-film thickness.

Embodiment 2

FIGS. 19 through 25 show a second embodiment of the present invention. Herein, the n-type ZnO as n-type semiconductor fine particles was used as the electron releasing substance to be adsorbed in the adsorption process, and it was contained in the $ZrO_2$ film 21 through the chemical conversion process to make a developed film of the present embodiment. In this example, the content ratio of the n-type ZnO to the $ZrO_2$ film 21 was 5.6 mass %, and the n-type ZnO had the following composition and characteristics:

Composition: Ga-Doped ZnO

Volume resistivity: 20 to 100 (Ω·cm)

Specific surface area: 30 to 50 ($m^2/g$)

Average particle size (primary particle size): 20 to 40 (nm)

Figure 19:
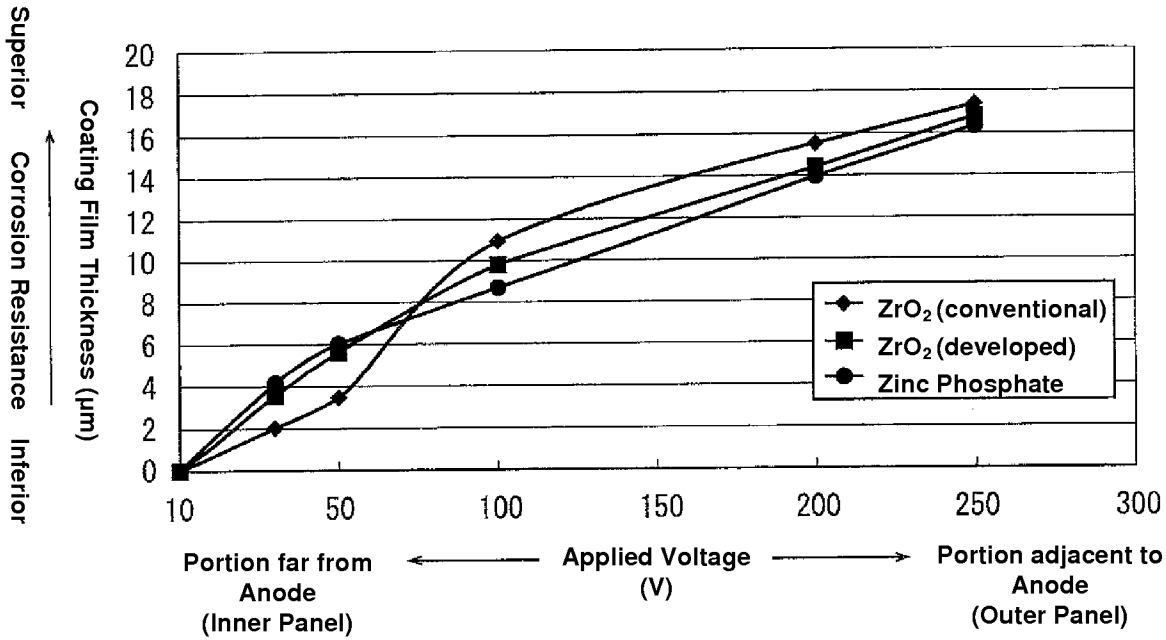
FIG. 19 is a graph showing a coating-film thickness characteristic of a $ZrO_2$ film containing n-type ZnO according to a second embodiment of the present invention, the $ZrO_2$ film, and the zinc phosphate film.
Figure 20:
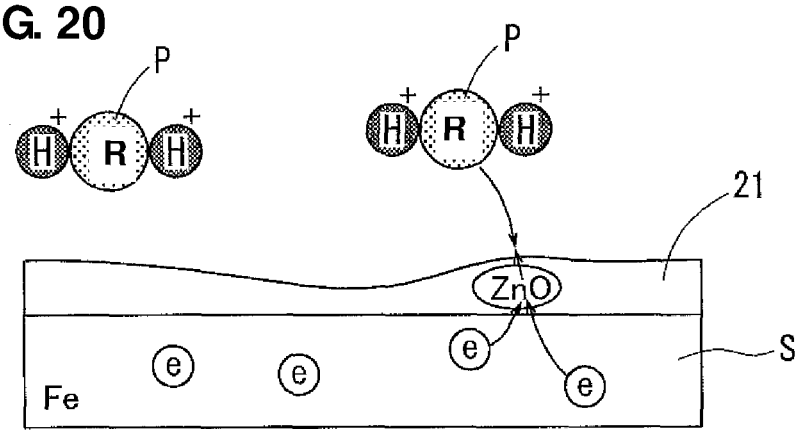
FIG. 20 is an explanatory diagram conceptually showing deposition of a coating film on the $ZrO_2$ film containing n-type ZnO.

According to the results of FIG. 19, the coating-film thickness characteristic (electrodeposition coatability) of the $ZrO_2$ film containing the n-type ZnO (semiconductor fine particles) became similar to that of the zinc phosphate film 1. This is because it can be considered that in case the $ZrO_2$ film 21 containing the n-type ZnO was used as a chemical conversion film, the number of free electrons (local electrical-conductive areas) was increased during the voltage application to promote the deposition of the coating film (resin) F onto the surface of the steel sheet S, as shown in a conceptual diagram of FIG. 20. In this case, an applied voltage to increase the number of free electrons is preferably set at a value greater than a corrosion potential (e.g., about 1 V). In FIG. 20, reference character P denotes a coating material having water solubility given by acid.

Figure 21:
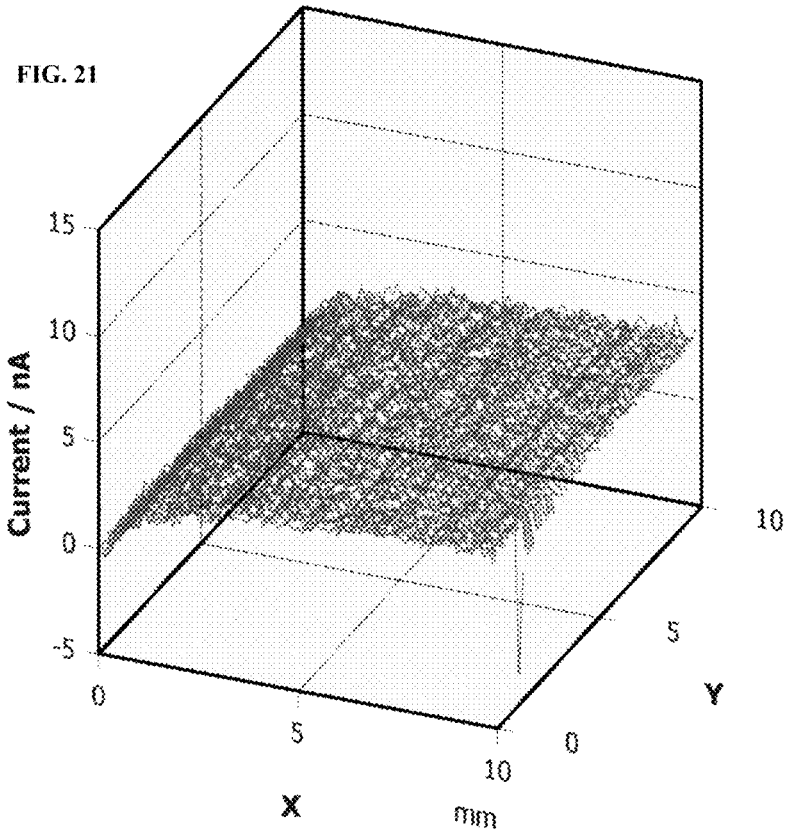
FIG. 21 is a graph showing a current density distribution during non-voltage application, in each of the $ZrO_2$ film and the $ZrO_2$ film containing n-type ZnO.
Figure 22:
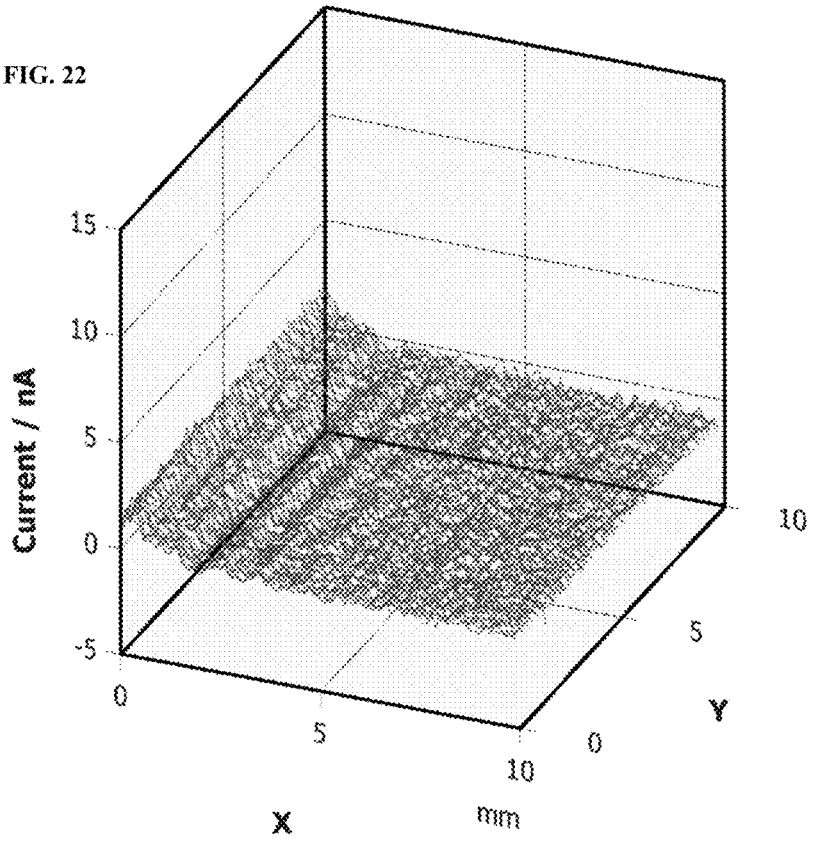
FIG. 22 is a graph showing a current density distribution during voltage (1 V) application, in the $ZrO_2$ film.
Figure 23:
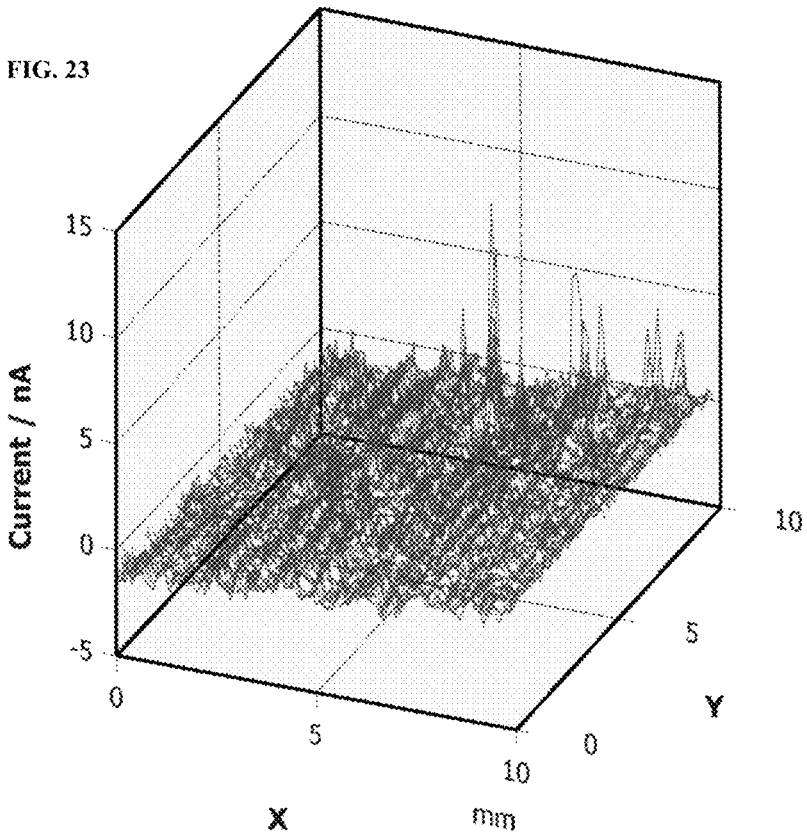
FIG. 23 is a graph showing a current density distribution during voltage (1 V) application, in the $ZrO_2$ film containing n-type ZnO.

FIGS. 21 through 23 show results of measurement of a current density distribution on a surface of each of the $ZrO_2$ film 21 (not containing the n-type ZnO) and the $ZrO_2$ film 21 containing the above-described n-type ZnO by using a scanning vibrating electrode technique (SVET). FIG. 21 is a graph showing the current density distribution during non-voltage application, in each of the conventional $ZrO_2$ film and the $ZrO_2$ film containing the n-type ZnO. In this case, no current was detected in either measurement. FIG. 22 is a graph showing the current density distribution during voltage (1 V) application, in the $ZrO_2$ film. In this case, no current was detected, either. FIG. 23 is a graph showing the current density distribution during voltage (1 V) application, in the $ZrO_2$ film 21 containing the n-type ZnO. In this case, a current was detected as shown in FIG. 23. This verified that the n-type ZnO contributes to an increase in the number of free electrons (local electrical-conductive areas), so as to promote deposition of a coating film F.

FIG. 24 is a table showing an influence of a content ratio of the n-type ZnO (semiconductor fine particles) to the $ZrO_2$ film containing the n-type ZnO, on the film thickness (electrodeposition coatability) of the coating film and the corrosion resistance. As seen in FIG. 24, the film thickness (electrodeposition coatability) of the coating film becomes greater (thicker) along with an increase in amount (mass %) of the n-type ZnO, and a problem about the corrosion resistance occurs when the amount (mass %) of the n-type ZnO is increased up to a specified value or more although the corrosion resistance is in an allowable range when the amount is less than the specified value. The corrosion resistance was evaluated based on measurement of the swelling rate (%) of the coating film F after 60 cycles of cyclic corrosion tests (CCTs) (1 cycle of the CCT is approximately equal to 3 cycles of JIS K5600-7-9 cycle A).

Figure 25:
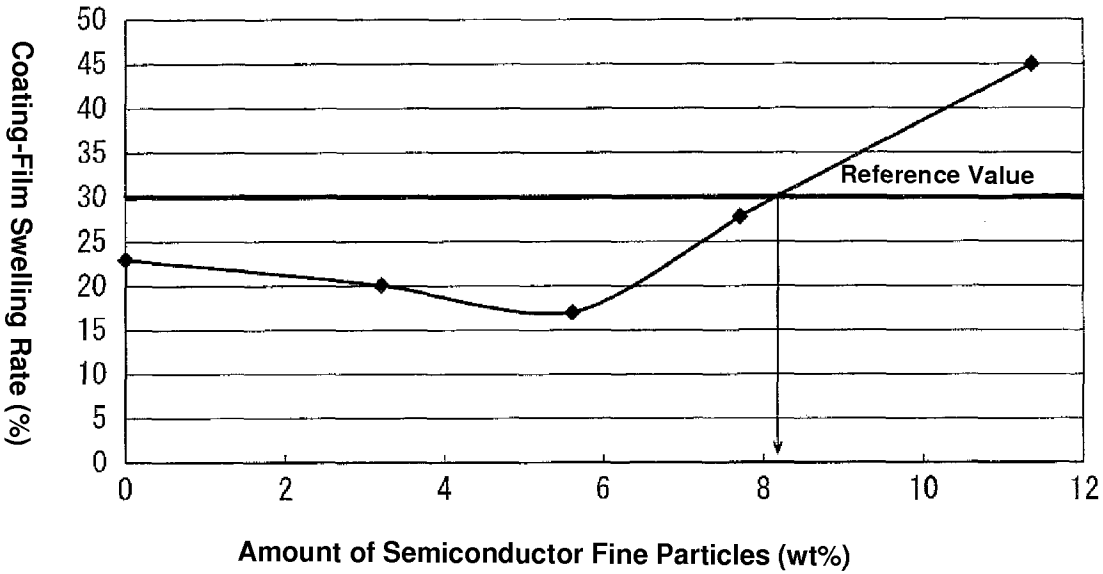
FIG. 25 is an explanatory graph showing a technique of determining an upper limit of the amount (mass %) of n-type ZnO in view of corrosion resistance.

FIG. 25 shows a technique of determining an upper limit of the amount (mass %) of the n-type ZnO in view of the corrosion resistance. Specifically, the relationship between the amount (mass %) of the n-type ZnO and the coating-film swelling rate (%) of the coating film F after 60 cycles of the CCTs in FIG. 24 is plotted in FIG. 25, and an upper limit of the amount (mass %) of the n-type ZnO is determined based on a coating-film swelling rate of 30(%) which is used as an allowable limit (reference value) of the corrosion resistance. In this case, a coating-film swelling rate of 30(%) is used as an allowable limit (reference value) of the corrosion resistance. This is based on the following reason. A 12-year warranty against a rust hole of an outer panel of a vehicle body becomes mainstream, and it has been confirmed by past records that the warranty is satisfied when the coating-film swelling rate is less than 30(%). As seen in FIG. 25, the amount (mass %) of the n-type ZnO at the allowable limit of the corrosion resistance is 8.2 mass %. That is, it is necessary to set the amount of the n-type ZnO at 8.2 mass % or less in order to ensure the corrosion resistance.

Embodiment 3

Figure 26:
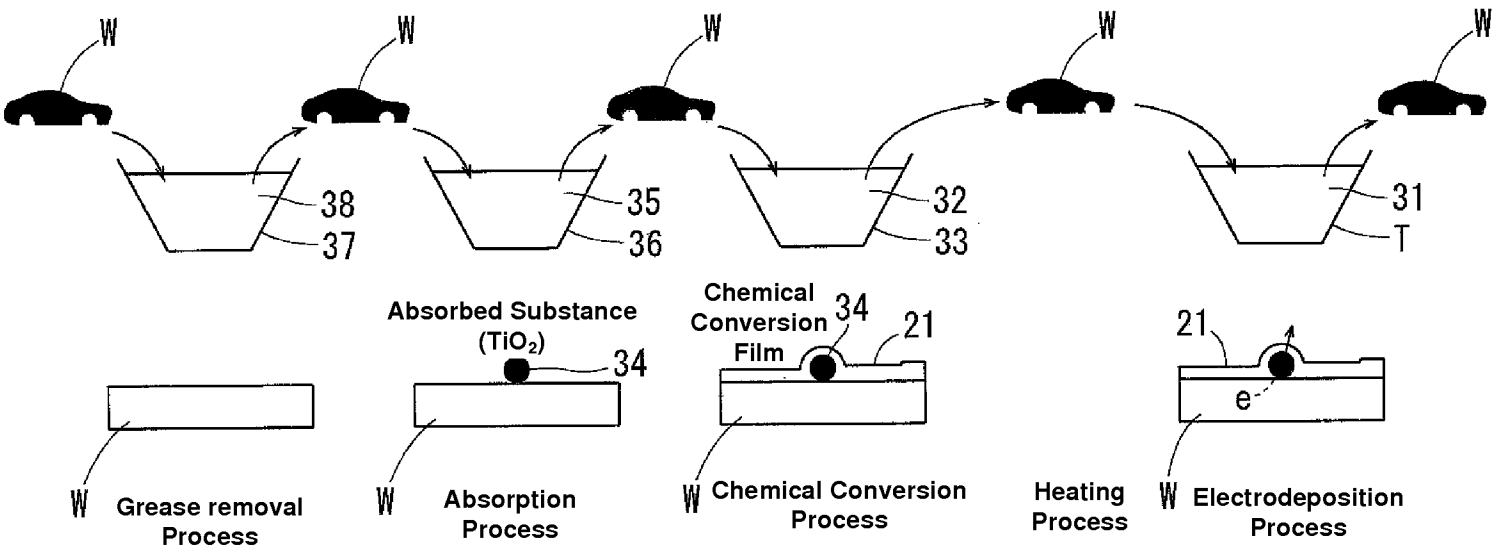
FIG. 26 is a process diagram showing manufacturing processes according to a third embodiment of the present invention.

A third embodiment, which is shown in FIG. 26, shows manufacturing processes, in which a doping treatment of an electron releasing-related substance which is adsorbed in the adsorption process is applied to a chemical conversion film before the electrodeposition coating process and thereby the chemical conversion film is formed on the n-type semiconductor. In the third embodiment, an electron releasing-related substance which has a greater electric charge number than the chemical conversion film (Zr) was used and it was adsorbed into the vehicle body W in the adsorption process. Then, the vehicle body W was heated (anneal treatment) in a heating process which is before the electrodeposition coating process and after the chemical conversion process, so that a doping treatment of the electron releasing substance was applied to the chemical conversion film. Specific manufacturing conditions were as follows:

(i) Electron releasing substance: Ti, Zn as a metal, an oxide of which becomes semiconductor; halogen, such as F or Cl, which becomes a n-type through replacement with oxygen; a group of 5, such as P or As, which becomes a n-type through replacement with Zr (ii) Conditions of heating (anneal treatment) process: 400 to 800° C.

Thereby, the number of free electrons can be increased in the chemical conversion film during the voltage application in the electrodeposition coating process, so that the electrodeposition coatability can be improved as well.

Embodiment 4

Figure 27:
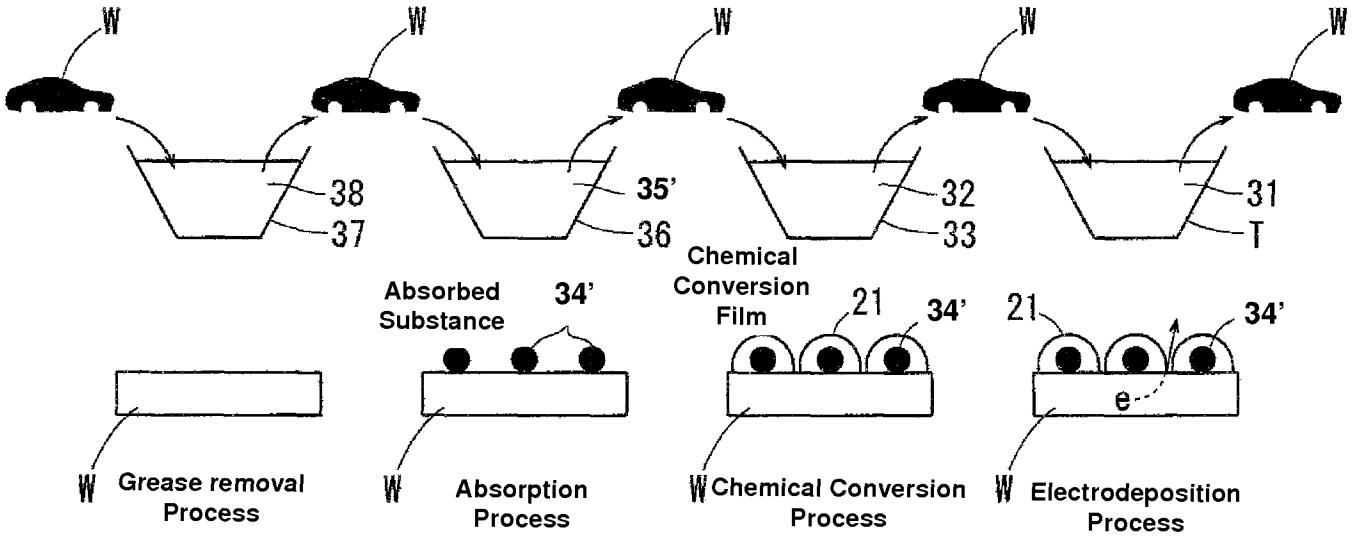
FIG. 27 is a process diagram showing manufacturing processes according to a fourth embodiment of the present invention.

A fourth embodiment of the present invention will be described referring to FIGS. 27 through 33. FIG. 27 is a process diagram showing manufacturing processes according to a fourth embodiment of the present invention. In this figure, the same portions as those in the above-described manufacturing processes of the first embodiment which is shown in FIG. 1 are denoted by the same reference characters, and detailed description of those are omitted here.

According to the fourth embodiment, as shown in FIG. 27, an adsorption (attachment) process is provided after the grease removal process (where the vehicle body W is immersed in the grease removing solution 38 contained in the grease removal tank 37 for a period of time 180 sec., for example, to remove grease, dust and the like which are attached onto the vehicle body W) and before the chemical conversion process. In this adsorption process, an electrically conductive substance 34' is adsorbed in (attached onto) the vehicle body W. The reason for this is to form an uneven surface of the vehicle body W through the adsorption treatment of the electrically conductive substance 34' so that the chemical conversion film 21 formed on the vehicle body W in the subsequent chemical conversion process can have a large number of local low-resistance areas (i.e., thin film portions (superior electrical-conductive areas).

Specifically, a metal of Cu (i.e., copper) is used as the electrically conductive substance 34' according to the present embodiment, and the metal Cu exists in an ion state in a treatment solution 35' contained in the adsorption treatment tank 36 (e.g., a copper sulfate solution is used as the treatment solution). In this case, the density of Cu ion of the treatment solution 35' is set at 5 to 500 ppm, having pH 2 to 5 and a solution temperature (bath tempt.) of 10 to 40° C., in view of the coating-film thickness (electrodeposition characteristic) and corrosion resistance.

Figure 28:
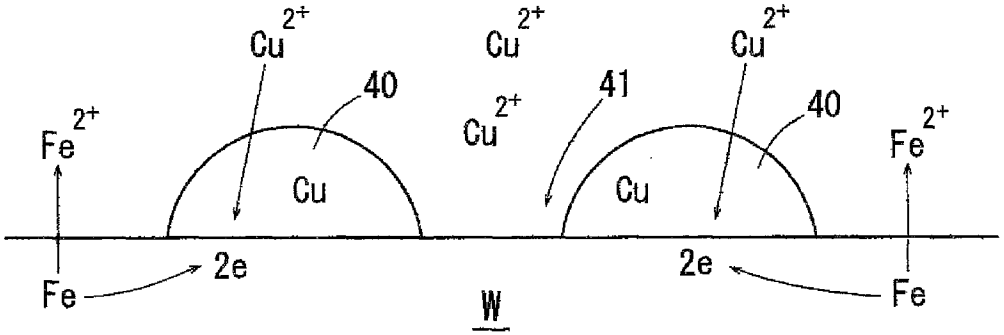
FIG. 28 is an explanatory diagram conceptually showing an adsorption process.
Figure 29:
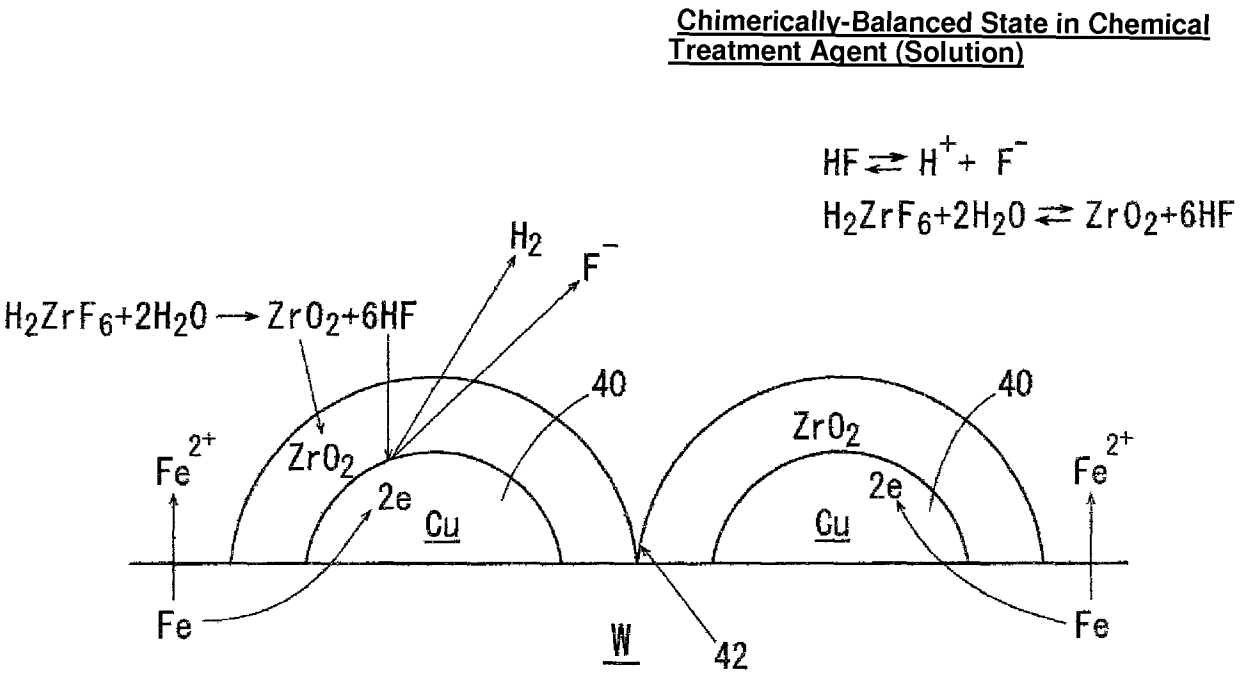
FIG. 29 is an explanatory diagram conceptually showing a chemical conversion process.

In this adsorption process, the vehicle body W is immersed in the treatment solution 35' as the attachment treatment. Thereby, as shown in FIG. 28, Fe as a component of the vehicle body W is ionized to release electrons, and the released electrons are combined with $Cu^{2+}$ in the treatment solution 35', resulting in deposition of Cu on the surface of the vehicle body W, which is expressed by the following reaction formula 6. Herein, an immersion period of time is set at about 10 to 600 sec. (30 sec. in the present embodiment) in view of the deposition (adsorption) of Cu.

$$Fe \rightarrow Fe^{2+} + 2e^-$$

$$Cu^{2+} + 2e^- \rightarrow Cu \qquad \text{(Reaction formula 6)}$$

Accordingly, the surface of the vehicle body W becomes uneven by the deposition of Cu as shown in FIG. 28 (conceptual diagram) (the height from a bottom face of a concave portion 41 (the surface of the vehicle body W) to a top face of a convex portion 40 is about some nm). This uneven state of the surface of the vehicle body W is caused by local difference in an etching reaction (deposition reaction) due to differences in a degree of surface oxidization and a state of electrons. Herein, the differences in the degree of surface oxidization and the state of electrons are caused by the unevenness (Ra=some μm) of the surface of the vehicle body (steel plate) W, local composition, and difference in a direction of crystal face. Accordingly, Cu is deposited mainly at regions of the surface of the vehicle body W where the etching reaction occurs easily, thereby forming the convex portions 40 at the regions. The convex portions 40 comprised of the deposited Cu may have a circular shape, an oval shape, or their combined shape. Between the convex portions 40 are formed the concave portions 41, where the surface of the vehicle body W (bottom face of the concave portions 41) is exposed to the outside. Herein, a metal connection (adsorption) occurs between each of the deposited Cu or the deposited Cu and Fe (the component of the vehicle body W), so that the deposited Cu may not come off the vehicle body W even if the vehicle body W is immersed in the tank 33 in the chemical conversion process.

Figure 30:
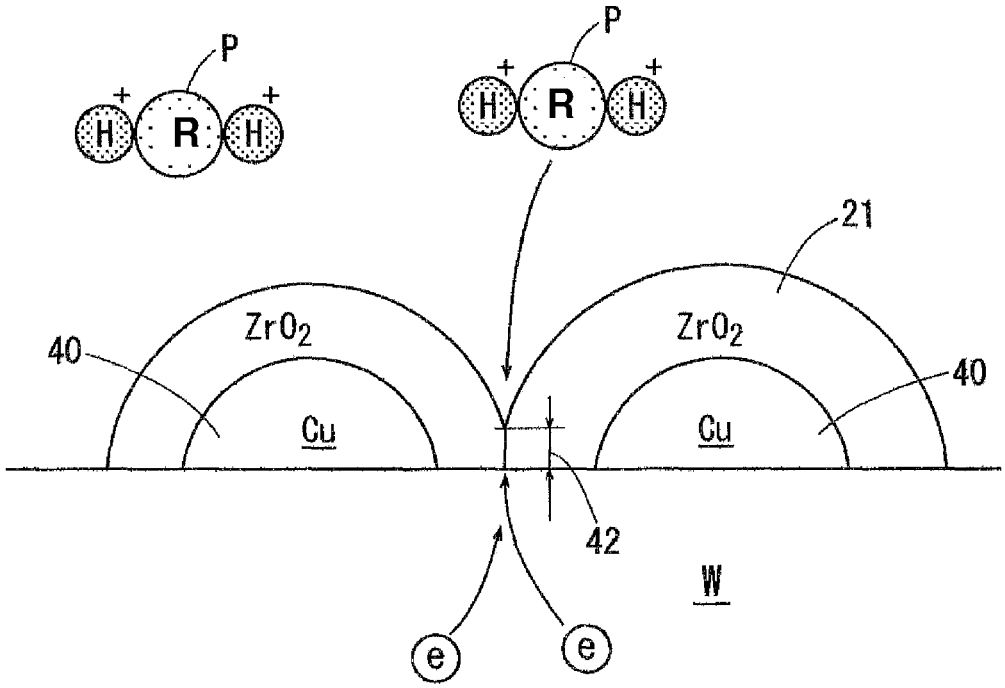
FIG. 30 is an explanatory diagram conceptually showing an electrodeposition coating process.

Accordingly, in case the vehicle body W which has been treated in the adsorption process is immersed in the tank 33 in the subsequent chemical conversion process, according to the above-described reaction formulas 1 to 5, the electrons from the ionization of the component (Fe) of the vehicle body W move to the convex portions 40 with Cu having a higher electrical potential, and $ZrO_2$ is deposited positively on the convex portions 40 based on the above-described electrons. Meanwhile, the component (Fe) of the vehicle body W is exposed at the concave portions 41 between the adjacent convex portions 40, where $ZrO_2$ are not deposited very much (the electrical potential of Fe is smaller than that of Cu). Therefore, the film thickness of $ZrO_2$ of the concave portions 41 is smaller than (thinner) than that of the other portion (convex portions 40), and thin film portions 42 are formed. As a result, in the electrodeposition coating process after the chemical conversion process, as shown in FIG. 30, the thin film portions 42 of the chemical conversion film 21 become the local low-resistance areas, so that the deposition of the coating film can be promoted by these thin film portions 42 as electrical-conductive areas during the voltage application in the electrodeposition coating process. Accordingly, the electrodeposition coatability at the low voltage-applied regions can be improved.

Thus, the coating-film thickness characteristic (electrodeposition characteristic) of the chemical conversion film ($ZrO_2$ film which is formed on Cu deposited on the surface of the vehicle body W), which has been finally formed through the adsorption process and the chemical conversion process, becomes similar to that of the crystalline zinc phosphate film 1. As a result, the eutrophication can be prevented and the production of waste sludge associated can be suppressed, and also the excellent corrosion resistance and electrodeposition coatability can be obtained.

More specifically, the basic functions, such as the corrosion resistance, are ensured by the properties of the chemical conversion film 21 occupying its most part (with an extremely small amount of deposited component 34'), and an excessive deposition of the coating film F onto the outer panel of the vehicle body W adjacent to the anode is suppressed by a relative decrease of the ratio of the chemical conversion component based on containment of Cu in the chemical conversion film 21. Further, a large number of local low-resistance areas (i.e., thin film portions 42, superior electrical-conductive portions) are formed at the chemical conversion film 21 in the chemical conversion process based on the shape of the concave portions 41 between the adjacent convex portions 40 of Cu deposited in the adsorption process. Thus, the electrodeposition coatability on the inner panel of the vehicle body W far from the anode in the low voltage-applied region can be improved.

Herein, in terms of the above-described problem (the film thickness of the coating film at the portion of the workpiece adjacent to the anode which belongs to the high voltage-applied region becomes fairly greater than that of the case of the zinc phosphate film, whereas the film thickness of the coating film at the portion of the workpiece far from the anode which belongs to the low voltage-applied region becomes considerably smaller than that of the case of the zinc phosphate film), it may be considered that the respective low-resistance areas 22 at the $ZrO_2$ film (Cu is not deposited in the adsorption process) are so decreased by some method that the electric charges do not concentrate in the respective low-resistance areas 22. In this case, however, the thickness of the film may increase, so that the deposition of the coating film may not occur unless a voltage to initiate the deposition of the coating film is increased further. In contrast, in case Cu is deposited in the adsorption process and the $ZrO_2$ film 21 is formed on that, the supplied electrons increase during the voltage application (the number of electrical-conductive areas increase) at the thin film portions 42. Consequently, the concentration of the electric charges in the respective low-resistance areas 22 can be avoided. Thus, the above-described problem (the coating-film thickness characteristic of the $ZrO_2$ film 21 becomes similar to that of the crystalline zinc phosphate film 1) can be avoided.

Figure 31:
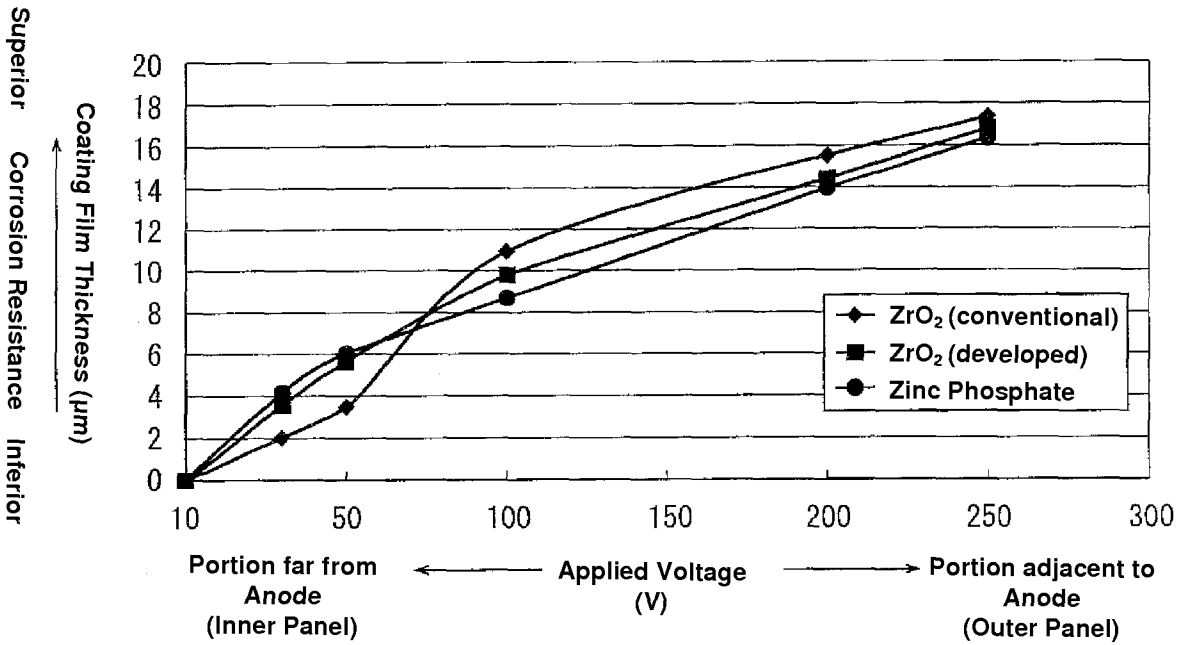
FIG. 31 is a graph showing a coating-film thickness characteristic of a $ZrO_2$ film formed on Cu deposited in the adsorption processes, the $ZrO_2$ film, and the zinc phosphate film.

FIG. 31 shows a coating-film thickness characteristic of the $ZrO_2$ film formed on the vehicle body W through the deposition of Cu in the adsorption process for the purpose of supporting the above-described contents. Herein, a test sample used a vehicle body which was immersed in the treatment solution 35' containing the Cu ion in the adsorption process, and then it was immersed in the chemical treatment agent 32 in the chemical conversion process. The specific test conditions were as follows:

(1) Adsorption Process

Composition of the treatment solution: Cu $(NO_3)_2$ 50 ppm, NaOH (for pH adjustment)

pH of the treatment solution: 3

Temperature of the treatment solution: 30° C.

Immersion period of time of the test vehicle body: 30 sec.

(2) Chemical Conversion Process

Composition of the chemical treatment agent: zirconium acid $H_2ZrF_6$, fluoric acid (HF), water-soluble resin pH of the chemical conversion treatment agent: 4

Immersion period of time of the test vehicle body: 180 sec.

Temperature of the chemical conversion treatment agent (bath tempt.): 30° C.

According to the results of FIG. 31, the coating-film thickness characteristic (electrodeposition coatability) of the $ZrO_2$ film 21 formed on the vehicle body W through the deposition of Cu in the adsorption process became similar to that of the zinc phosphate film 1. This is because it can be considered that the chemical conversion film 21 forms the thin film portions 42 with the concave portions 41 formed between the adjacent convex portions 40 of Cu, and these thin film portions 42 become the local low-resistance areas (superior electrical-conductive areas), thereby promoting the deposition of the coating film (resin) F, as shown in a conceptual diagram of FIG. 30. In this case, an applied voltage to increase the number of electrical-conductive areas is preferably set at a value greater than a corrosion potential (e.g., about 1 V). In FIG. 30, reference character P denotes a coating material having water solubility given by acid.

Figures 32, 33:
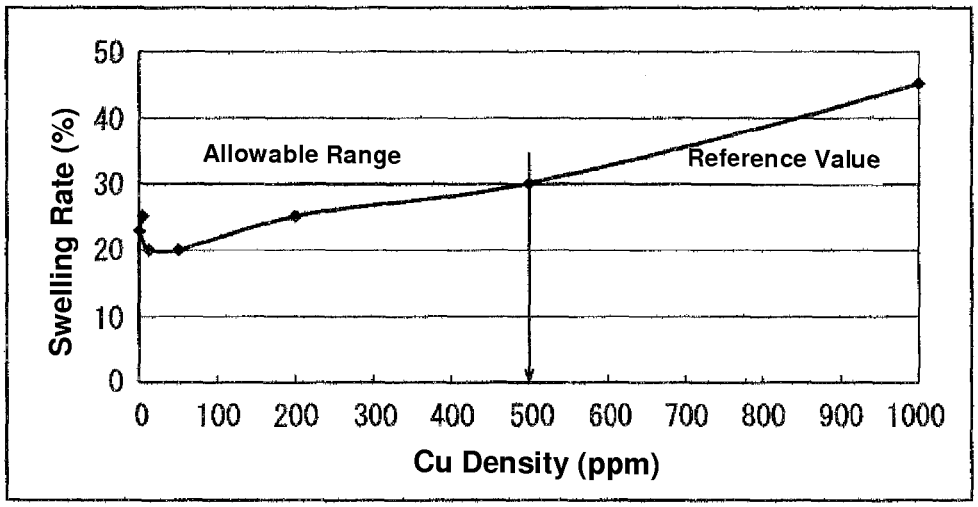
FIG. 32 is a table showing influence of density of Cu ion in a treatment solution contained in an adsorption treatment tank in the adsorption process on the coating-film thickness (electrodeposition characteristic) and the corrosion resistance.
FIG. 33 is an explanatory graph showing a technique of determining an upper limit of the density of the Cu ion (ppm) in view of corrosion resistance.

FIG. 32 is a table showing an influence of the density of the Cu ion in the treatment solution 35' in the adsorption process on the coating-film thickness (electrodeposition coatability) and the corrosion resistance. As seen in FIG. 32, the coating-film thickness becomes greater (thicker) along with an increase in the density of the Cu ion and then turns to decrease when reaching a specified value, and a problem about the corrosion resistance occurs when the density (ppm) of the Cu ion is increased up to a specified value or more although the corrosion resistance is in an allowable range when the amount is less than the specified value. Herein, it was set in any case of the respective treatment solutions 35' in the adsorption process that the immersion period of time of the vehicle body W in the adsorption treatment tank 36 was 30 sec., the temperature of the treatment agent in the adsorption treatment tank (bath tempt.) was 30° C., and pH of the treatment solution was 3, and the conditions used in the test shown in FIG. 31 were used as the conditions of the chemical conversion process. Further, the corrosion resistance was evaluated based on measurement of a swelling rate (%) of the coating film F after 60 cycles of cyclic corrosion tests (CCTs) (1 cycle of the CCT is approximately equal to 3 cycles of JIS K5600-7-9 cycle A).

FIG. 33 shows a technique of determining an upper limit of the density of the Cu ion (ppm) in the treatment solution 35' in view of the corrosion resistance. That is, the relationship between the Cu ion density (ppm) and the coating-film F swelling rate (%) after 60 cycles of the CCTs in FIG. 32 is plotted in FIG. 33, and the upper limit of the Cu ion density (ppm) in the treatment solution is determined based on a coating-film swelling rate of 30(%) which is used as an allowable limit (reference value) of the corrosion resistance. In this case, the coating-film swelling rate of 30(%) is used as the allowable limit (reference value) of the corrosion resistance. This is based on the following reason. A 12-year warranty against a rust hole of the outer panel of the vehicle body becomes mainstream, and it has been confirmed by past records that the warranty is satisfied when the coating-film swelling rate is less than 30(%). Herein, 1 cycle of the CCT is approximately equal to 3 cycles of JIS K5600-7-9 cycle A. According to FIG. 33, the density of the Cu ion in the treatment solution in the adsorption process at the allowable limit of corrosion resistance is 500 ppm. That is, it is necessary to set the Cu ion density in the treatment solution at 500 ppm or less in order to ensure the corrosion resistance. Meanwhile, with respect to a lower limit, is necessary to set that at 5 ppm or more in order to ensure the coating-film thickness.

The present invention should not be limited to the above-described embodiments, and any other modifications and improvements may be applied within the scope of a sprit of the present invention. For example, the electron releasing-related substance or the electrically conductive substance may be attached onto the vehicle body (workpiece to be coated) through any other treatment using spray, deposition, thermal spraying or the like instead of the immersion treatment.

What is claimed is:

1. A surface treatment method of a metal material, comprising:

attaching an electron releasing-related substance onto a surface of the metal material in an adsorption process; and applying a chemical conversion treatment to the metal material having the electron releasing-related substance attached thereto, using a chemical conversion treatment agent, in a chemical conversion process which is provided before an electrodeposition coating process such that an energy band gap of a finally-formed chemical conversion film is smaller than that of a chemical conversion film formed by using only the chemical conversion treatment agent, wherein a compound having at least one selected from a group consisting of Zr, Ti, Hf and Si as a primary component is used as said chemical conversion treatment agent so that the chemical conversion film can be an oxide compound having at least one selected from the group consisting of Zr, Ti, Hf and Si.

2. The surface treatment method of a metal material of claim 1, wherein an electron releasing substance to make the energy band gap of the finally-formed chemical conversion film be smaller than that of the chemical conversion film formed by using only the chemical conversion treatment agent is used as said electron releasing-related substance so that said finally-formed chemical conversion film can be the chemical conversion film formed by using only the chemical conversion treatment agent which contains said electron releasing substance.

3. The surface treatment method of a metal material of claim 2, wherein at least one kind of metal fine particles, n-type semiconductor fine particles, genuine semiconductor fine particles, electrically conductive organic fine particles, and electrical insulator fine particles is used as said electron releasing substance.

4. The surface treatment method of a metal material of claim 2, wherein said electron releasing substance is titanous oxide which excites an electron by applying an energy exceeding a specified energy band gap.

5. The surface treatment method of a metal material of claim 2, wherein titanous oxide which excites an electron by applying an energy exceeding a specified energy band gap is used as said electron releasing substance, and the metal material is immersed in a treatment solution in which fine particles of the titanous oxide are in a dispersed state with a density of 10 to 500 ppm in case of attaching the titanous oxide onto the surface of the metal material.

6. The surface treatment method of a metal material of claim 5, wherein a protective colloid is used in case of making said fine particles of the titanous oxide in the dispersed state in said treatment solution.

7. A surface treatment method of a metal material, comprising:

attaching an electron releasing-related substance onto a surface of the metal material in an adsorption process; and applying a chemical conversion treatment to the metal material having the electron releasing-related substance attached thereto, using a chemical conversion treatment agent, in a chemical conversion process which is provided before an electrodeposition coating process such that an energy band gap of a finally-formed chemical conversion film is smaller than that of a chemical conversion film formed by using only the chemical conversion treatment agent, wherein a doping treatment of said electron releasing-related substance is applied to the chemical conversion film formed by using only the chemical conversion treatment agent before the electrodeposition coating process so that the finally-formed chemical conversion film can be a n-type semiconductor having surplus electrons.

8. The surface treatment method of a metal material of claim 7, wherein a substance having a greater electric charge number than the chemical conversion film is used said electron releasing-related substance in case of applying said doping treatment, and a heating treatment is applied to the chemical conversion film formed by using only the chemical conversion treatment agent and the electron releasing-related substance in the chemical conversion film after said treatment of forming the chemical conversion film.

* * * * *